US006620581B1

(12) United States Patent
Parton et al.

(10) Patent No.: US 6,620,581 B1
(45) Date of Patent: Sep. 16, 2003

(54) PHOTOGRAPHIC MATERIAL HAVING ENHANCED LIGHT ABSORPTION

(75) Inventors: Richard L. Parton, Webster, NY (US); Joseph C. Deaton, Rochester, NY (US); William J. Harrison, Rochester, NY (US); Margaret J. Helber, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 48 days.

(21) Appl. No.: 09/690,068

(22) Filed: Oct. 16, 2000

(51) Int. Cl.[7] ..... G03C 1/08; G03C 7/26; G03C 7/32

(52) U.S. Cl. ..... 430/559; 430/570; 430/572; 430/574; 430/577; 430/581; 430/576

(58) Field of Search ..... 430/570, 572, 430/574, 559, 577, 581, 576

(56) References Cited

U.S. PATENT DOCUMENTS

| | | | | |
|---|---|---|---|---|
| 2,518,731 A | | 8/1950 | Thompson | |
| 3,622,316 A | | 11/1971 | Bird et al. | |
| 3,976,493 A | | 8/1976 | Borror et al. | |
| 3,976,640 A | | 8/1976 | Borror et al. | |
| 4,040,825 A | | 8/1977 | Steiger et al. | |
| 4,138,551 A | | 2/1979 | Steiger et al. | |
| 4,950,587 A | | 8/1990 | Roberts et al. | |
| 6,143,486 A | * | 11/2000 | Parton et al. | 430/574 |
| 6,165,703 A | * | 12/2000 | Parton et al. | 430/572 |
| 6,312,883 B1 | * | 11/2001 | Parton et al. | 430/574 |
| 6,331,385 B1 | * | 12/2001 | Deaton et al. | 430/572 |
| 6,361,932 B1 | * | 3/2002 | Parton et al. | 430/572 |
| 6,387,610 B1 | * | 5/2002 | Yamashita et al. | 430/574 |

FOREIGN PATENT DOCUMENTS

| | | |
|---|---|---|
| EP | 0 270 079 | 6/1988 |
| EP | 0 270 082 | 6/1988 |
| EP | 0 472 004 A | 2/1992 |
| EP | 0 565 074 | 10/1993 |
| EP | 0 838 719 | 4/1998 |
| EP | 0 985 965 A | 3/2000 |
| EP | 0 985 966 A | 3/2000 |
| EP | 1 085 373 A2 | 3/2001 |
| JP | 64-91134 | 10/1989 |

OTHER PUBLICATIONS

Steiger et al. Photographic Science & Engineering, 1983, vol. 27, No. 2, pp. 59–65.
Penner et al., Photographic Science & Engineering, 1976, vol. 20, No. 3, pp. 97–106.
Penner, Photographic Science & Engineering, 1977, vol. 21, No. 1, pp. 32–36.
Bird, Photographic Science & Engineering, 1974, vol. 18, No. 5, pp. 562–568.
Forster, Disc. Faraday Soc., Laboratory of Physical Chemistry, Technische Hochschule, Stuttgart, 10th Spiers Memorial Lecture, "Transfer Mechanisms of Electronic Excitation", Apr. 14, 1959.

* cited by examiner

*Primary Examiner*—Geraldine Letscher
(74) *Attorney, Agent, or Firm*—Edith A. Rice

(57) ABSTRACT

This invention comprises a silver halide photographic material comprising at least one silver halide emulsion comprising silver halide grains having associated therewith at least two dyes:

(a) a first dye that has at least one anionic substituent and that is capable of spectrally sensitizing a silver halide emulsion; and (b) a second dye that absorbs light at an equal or shorter wavelength than the first dye and that has at least one cationic substituent and that is highly fluorescent.

46 Claims, No Drawings

PHOTOGRAPHIC MATERIAL HAVING ENHANCED LIGHT ABSORPTION

FIELD OF THE INVENTION

This invention relates to a silver halide photographic material containing at least one silver halide emulsion that has enhanced light absorption and high photographic sensitivity.

BACKGROUND OF THE INVENTION

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to increased surface area. However, in most photographic systems, it is still the case that not all the available light is being collected.

The yellow, magenta, and cyan layers in many color photographic materials could benefit from increased light absorption which could allow the use of smaller emulsions with less radiation sensitivity and improved color and image structure characteristics. For certain applications, it may be useful to enhance infrared light absorption in infrared sensitized photographic elements to achieve greater sensitivity and image structure characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.*, 18, 562 (1974)). One method is to synthesize molecules in which two dye chromophores are covalently connected by a linking group (see U.S. Pat. No. 2,518,731, U.S. Pat. No. 3,976,493, U.S. Pat. No. 3,976,640, U.S. Pat. No. 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion, however, they tended to sensitize poorly and dye stain (an unwanted increase in D-min due to retained sensitizing dye after processing) was severe in this system and unacceptable.

A different strategy involves the use of two dyes that are not connected to one another. In this approach the dyes can be added sequentially and are less likely to interfere with one another. Miysaka et al. in EP 270 079 and EP 270 082 describe silver halide photographic material having an emulsion spectrally sensitized with an adsorbable sensitizing dye used in combination with a non-adsorbable luminescent dye which is located in the gelatin phase of the element. Steiger et al. in U.S. Pat. No. 4,040,825 and U.S. Pat. No. 4,138,551 describe silver halide photographic material having an emulsion spectrally sensitized with an adsorbable sensitizing dye used in combination with a second dye that is bonded to gelatin. The problem with these approaches is that unless the dye not adsorbed to the grain is in close proximity to the dye adsorbed on the grain (less than 50 angstroms separation) efficient energy transfer will not occur (see T. Förster, *Disc. Faraday Soc.*, 27, 7 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.*, 27, 59 (1983)).

A more useful method is to have two or more dyes form layers on the silver halide grain. Penner and Gilman described the occurrence of greater than monolayer levels of cyanine dye on emulsion grains, *Photogr. Sci. Eng.*, 20, 97 (1976); see also Penner, *Photogr. Sci. Eng.*, 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. The problem with previous dye layering approaches was that the dye layers described produced a very broad sensitization envelope. This would lead to poor color reproduction since, for example, the silver halide grains in the same color record would be sensitive to both green and red light.

Yamashita et. al. (EP 838 719 A2) describes the use of two or more cyanine dyes to form more than one dye layer on silver halide emulsions. The dyes are required to have at least one aromatic or heteroaromatic substituent attached to the chromophore via the nitrogen atoms of the dye. Yamashita et. al. teaches that dye layering will not occur if this requirement is not met. This is undesirable because such substitutents can lead to large amounts of retained dye after processing (dye stain) which affords increased D-min. We have found that this is not necessary and that neither dye is required to have at least one aromatic or heteroaromatic substitute attached to the chromophore via the nitrogen atoms of the dye.

PROBLEM TO BE SOLVED BY THE INVENTION

Not all the available light is being collected in many photographic systems. The yellow, magenta, and cyan layers in many photographic products could benefit from increased light absorption which could allow the use of smaller emulsions with less radiation sensitivity and improved color and image quality characteristics. For certain applications, it may be useful to enhance infrared light absorption in infrared sensitized photographic elements to achieve greater sensitivity and image quality characteristics.

In some cases the excited state lifetimes of dyes are too short to allow efficient energy transfer between dye layers. For example, dyes that absorb red light and that could be used in an additional dye layer often have excited state lifetimes that are very short. This is indicated by a weak fluorescence when the dye is aggregated in aqueous gelatin. We have found that red-light absorbing dyes that aggregate in aqueous gelatin and have a fluorescent signal above a certain threshold can give enhance photographic sensitivity when used to form a second layer on a red spectrally sensitized silver halide emulsion.

SUMMARY OF THE INVENTION

We have found that it is possible to form more than one dye layer on silver halide emulsion grains and that this can afford increased light absorption. The dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation-π interactions, etc. or by in situ bond formation. The inner dye layer(s) is adsorbed to the silver halide grains and contains at least one spectral sensitizer. The outer dye layer(s) (also referred to herein as an antenna dye layer(s)) absorbs light at an equal or higher energy (equal or shorter wavelength) than the adjacent inner dye layer(s). The light energy emission wavelength of the outer dye layer overlaps with the light energy absorption wavelength of the adjacent inner dye layer.

We have also found that silver halide grains sensitized with at least one dye containing at least one anionic substituent and at least one highly fluorescent dye containing at least one cationic substituent provides increased light absorption.

One aspect of this invention comprises a silver halide photographic material comprising at least one silver halide emulsion comprising silver halide grains having associated therewith at least two dyes:

(a) a first dye that has at least one anionic substituent and that is capable of spectrally sensitizing a silver halide emulsion; and (b) a second dye that absorbs light at an equal or shorter wavelength than the first dye and that has at least one cationic substituent and that is highly fluorescent.

The dyes of this invention preferably form a J-aggregate in aqueous gelatin. The J-aggregate formed preferably is highly fluorescent. It preferably has a fluorescence intensity above a certain threshold, as discussed in more detail below. The dyes also preferably have liquid-crystalline properties in aqueous gelatin. The dyes used in this invention afford improved spectral sensitivity.

Generally the first dye forms an inner dye layer around the silver halide grain and the second dye forms an outer dye layer. Either or both of the layers may contain one or more additional dyes.

The second dye preferably absorbs light at an equal or shorter wavelength than the first dye. The wavelength of maximum light absorption of the second dye can be equal to or slightly deeper than the wavelength of maximum light absorption of the first dye provided there is still substantial overlap between the light absorption envelope of the second dye and the light absorption envelope of the first dye. More preferably, the wavelength of maximum light absorption of the second dye is shorter than the wavelength of maximum light absorption of the first dye. In preferred embodiments of he invention the wavelength of maximum light absorption of the second dye is between 5 and 100 nm, more preferably between 5 and 50 nm, and most preferably 5 to 30 nm, shorter than the wavelength of maximum light absorption of the first dye.

ADVANTAGEOUS EFFECT OF THE INVENTION

The invention provides increased light absorption and photographic sensitivity by forming more than one layer of sensitizing dye on silver halide grains. The increased sensitivity could be used to improve granularity by using smaller emulsions and compensating the loss in speed due to the smaller emulsions by the increased light absorption of the dye layers of the invention. In addition to improved granularity, the smaller emulsions would have lower ionizing radiation sensitivity. Radiation sensitivity is determined by the mass of silver halide per grain. The invention also provides good color reproduction, i.e., no excessive unwanted absorptions in a different color record. This invention achieves these features whereas methods described in the prior art can not.

DETAILED DESCRIPTION OF THE INVENTION

As mentioned above, in preferred embodiments of the invention silver halide grains have associated therewith dyes layers that are held together by non-covalent attractive forces. Examples of non-covalent attractive forces include electrostatic bonding, van der Waals interactions, hydrogen bonding, hydrophobic interactions, dipole-dipole interactions, dipole-induced dipole interactions, London dispersion forces, cation-π interactions, etc. or by in situ bond formation, or any combinations of these. In situ bond formation between complimentary chemical groups would be valuable for this invention. For example, one layer of dye containing at least one boronic acid substituent could be formed. Addition of a second dye having at least one diol substituent could result in the formation of two dye layers by the in situ formation of boron-diol bonds between the dyes of the two layers. Another example of in situ bond formation would be the formation of a metal complex between dyes that are adsorbed to silver halide and dyes that can form a second or subsequent layer. For example, zirconium could be useful for binding dyes with phosphonate substituents into dye layers. For a non-silver halide example see H. E. Katz et. al., Science, 254, 1485, (1991).

In a preferred embodiment the current invention uses a combination of a cyanine dye capable of spectral sensitizing a silver halide emulsion with at least one anionic substituent as a first dye and a second dye, preferably a merocyanine dye, with at least one cationic substituent. In preferred embodiments, the first and/or the second dye has a net charge less than 2.

In order to realize the maximal light capture per unit area of silver halide, it is preferred that the dye or dyes of the outer dye layer (also referred to herein as antenna dye(s)), plus any additional dye layers in a multilayer deposition, also be present in a J-aggregated state. For the preferred dyes, the J-aggregated state affords both the highest extinction coefficient and fluorescence yield per unit concentration of dye. Furthermore, extensively J-aggregated secondary cationic dye layers are more robust, particularly with respect to desorption and delayering by anionic surfactant-stabilized color coupler dispersions. In addition, when the preferred dyes are layered above a conventional cyanine sensitizing dye of opposite charge which is adsorbed directly to the silver halide surface, the inherent structural dissimilarity of the two dye classes minimizes co-adsorption and dye mixing (e.g., cyanine dye plus merocyanine dye) on the grain. Uncontrolled surface co-aggregation between dyes of opposite charge (e.g. anionic cyanine plus cationic cyanine) can result in a variety of undesirable photographic effects, such as severe desensitization.

In one preferred embodiment, the antenna dye layer can form a well-ordered liquid-crystalline phase (a lyotropic mesophase) in aqueous media (e.g. water, aqueous gelatin, methanolic aqueous gelatin etc.), and preferably forms a smectic liquid-crystalline phase (W. J. Harrison, D. L. Mateer & G. J. T. Tiddy, *J. Phys. Chem.* 1996, 100, pp 2310–2321). More specifically, in one embodiment preferred antenna dyes will form liquid-crystalline J-aggregates in aqueous-based media (in the absence of silver halide grains) at any equivalent molar concentration equal to, or 4 orders of magnitude greater than, but more preferably at any equivalent molar concentration equal to or less than, the optimum level of primary silver halide-adsorbed dye deployed for conventional sensitization (see *The Theory of the Photographic Process*, $4^{th}$ edition, T. H. James, editor, Macmillan Publishing Co., New York, 1977, for a discussion of aggregation).

Mesophase-forming dyes may be readily identified by someone skilled in the art using polarized-light optical microscopy as described by N. H. Hartshorne in *The Microscopy of Liquid Crystals*, Microscope Publications Ltd., London, 1974. In one embodiment, preferred antenna dyes when dispersed in the aqueous medium of choice (including water, aqueous gelatin, aqueous methanol etc. with or without dissolved electrolytes, buffers, surfactants and other common sensitization addenda) at optimum concentration and temperature and viewed in polarized light as thin films sandwiched between a glass microscope slide and cover slip display the birefringence textures, patterns and flow rheology characteristic of distinct and readily identifiable structural types of mesophase (e.g. smectic, nematic, hexagonal). Furthermore, in one embodiment, the preferred dyes when dispersed in the aqueous medium as a liquid-crystalline phase generally exhibit J-aggregation resulting in a unique bathochromically shifted spectral absorption band yielding high fluorescence intensity. In another embodiment useful hypsochromically shifted spectral absorption bands may also result from the stabilization of a liquid-crystalline phase of certain other preferred dyes. In certain other embodiments of dye layering, especially in the case of dye layering via in situ bond formation, it may be desirable to use antenna dyes that do not aggregate.

Another aspect of the invention comprises an antenna dye that forms a liquid-crystalline phase in a hydrophilic colloid. For example when the dye is mixed 0.1% by weight in a 2.5% aqueous gelatin solution it forms a liquid-crystalline phase. Under these conditions the antenna dye preferably possesses a spectral absorbance maximum bathochromically shifted from its absorbance in methanol. Preferably the antenna dyes form a J-aggregate. The aggregated dye is preferably highly fluorescent.

Fluorescence quantum efficiency is a measurement that is useful and that can correlate with the excited state lifetime of a dye (see S. Fery-Forgues; D. Lavabre, *J. of Chem Edu.*, 76, 1260–1265 (1999)). The fluorescence quantum efficiency expresses the proportion of excited molecules that deactivate by emitting a fluorescence photon. It is the ratio of the number of emitted photons to the number of adsorbed photons per unit time. The fluorescence quantum efficiency of any material is determined by counting the number of photons emitted by the fluorescence process and dividing by the number of incident photons absorbed. A standard is used to determine relative fluorescence quantum efficiency. The relative difference between the incident power for the standard and the dye being measured can be incorporated in the quantum efficiency expression. Spectral correction can also be applied to the emission spectra to compensate for the variation in system sensitivity as a function of wavelength. Different solvents can be used for the samples and the standard provided a correction for the different indices of refraction is performed.

To be considered highly fluorescent, the relative fluorescence quantum efficiency of the dye, measure in 3% aqueous gelatin solution, should be greater than 0.02 and more preferably it should be greater than 0.05, even more preferably it should be greater than 0.1. The fluorescent species in a dye sample prepared at 1 mmolar concentration in 3% gelatin solution preferably should have an absorbance of about 0.2 or greater, and more preferably above 0.3 when measured in a 0.01 mm pathlength cell.

In a preferred embodiment, the first dye layer comprises one or more cyanine dyes. Preferably the cyanine dyes have at least one negatively charged substituent. In one preferred embodiment, the cyanine dyes of the first layer having at least one negatively charged substituent have a net charge of zero or one. In another preferred embodiment, the second dye layer comprises one or more merocyanine dyes. Preferably the merocyanine dyes have at least one positively charged substituent. In another preferred embodiment the second dye layer consists of a mixture of merocyanine dyes that have at least one positively charged substituent and merocyanine dyes that have at least one negatively charged substituent. Merocyanine dyes with anionic substituents are "Well known" in the literature (see Hamer, *Cyanine Dyes and Related Compounds*, 1964 (publisher John Wiley & Sons, New York, N.Y.)). Merocyanine dyes with cationic substituents have been described in U.S. Pat. No. 4,028,353. The antenna dyes may absorb light in the monomeric state or more preferably in the aggregated state and their maximum absorption should be at a shorter or equal wavelength compared to the maximum absorption of the sensitizing dye(s).

The dye or dyes of the first layer are added at a level such that, along with any other adsorbants (e.g., antifoggants), they will substantially cover at least 80% and more preferably at least 90% of the surface of the silver halide grain. The area a dye covers on the silver halide surface can be determined by preparing a dye concentration series and choosing the dye level for optimum performance or by well-known techniques such as dye adsorption isotherms (for example see W. West, B. H. Carroll, and D. H. Whitcomb, J. Phys. Chem, 56, 1054 (1962)).

In some cases, during dye addition and sensitization of the silver halide emulsion, it appears that excess gelatin can interfere with the dye layer formation. In some cases, it is preferred to keep the gelatin levels below 8% and preferably below 4% by weight. Additional gelatin can be added, if desired, after the dye layers have formed.

In one preferred embodiment, a molecule containing a group that strongly bonds to silver halide, such as a mercapto group (or a molecule that forms a mercapto group under alkaline or acidic conditions) or a thiocarbonyl group is added after the first dye layer has been formed and before the second dye layer is formed. Mercapto compounds represented by the following formula (A) are particularly preferred. Also, mercaptotriazoles and 2-mercaptoimidazoles are useful.]

A

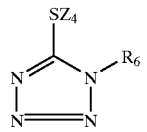

wherein $R_6$ represents an alkyl group, an alkenyl group or an aryl group and $Z_4$ represents a hydrogen atom, an alkali metal atom, an ammonium group or a protecting group that can be removed under alkaline or acidic conditions. Examples of some preferred mercapto compounds are shown below.

A-1

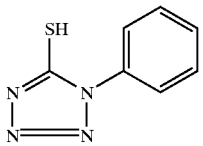

A-2

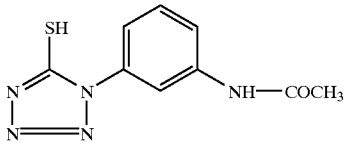

A-3

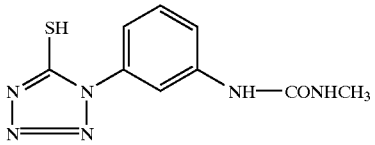

A-4

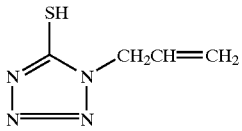

A-5

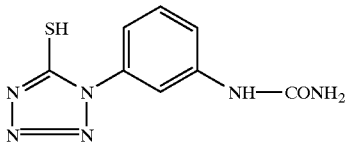

In describing preferred embodiments of the invention, one dye layer is described as an inner layer and one dye layer is described as an outer layer. It is to be understood that one or more intermediate dye layers may be present between the inner and outer dye layers, in which all of the layers are held together by non-covalent forces, as discussed in more detail above. Further, the dye layers need not completely encompass the silver halide grains of underlying dye layer(s). Also some mixing of the dyes between layers is possible.

The first dye is any dye capable of spectrally sensitizing a silver halide emulsion, for example, a cyanine dye, merocyanine dye, complex cyanine dye, complex merocyanine dye, homopolar cyanine dye,or hemicyanine dye, etc. Of these dyes, merocyanine dyes containing a thiocarbonyl group and cyanine dyes are particularly useful. Of these, cyanine dyes are especially useful. The first dye (also referred to herein as the inner dye or dye of the inner dye layer) is preferably a cyanine dye of Formula Ia or a merocyanine dye of Formula Ib:

Ia

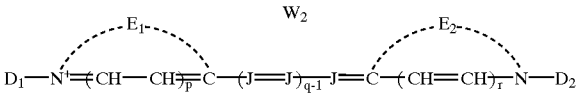

wherein:

$E_1$ and $E_2$ may be the same or different and represent the atoms necessary to form a substituted or unsubstituted heterocyclic ring which is a basic nucleus (see *The Theory of the Photographic Process*, 4th edition, T. H. James, editor, Macmillan Publishing Co., New York, 1977 for a definition of basic and acidic nucleus), each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl and at least one of $D_1$ and $D_2$ contains an anionic substituent, $W_2$ is one or more counterions as necessary to balance the charge;

Ib

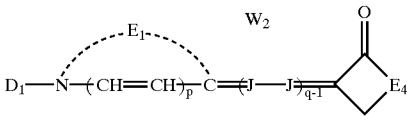

wherein $E_1$, $D_1$, J, p, q and $W_2$ are as defined above for Formula (Ia) wherein $E_4$ represents the atoms necessary to complete a substituted or unsubstituted heterocyclic acidic nucleus which preferably contains a thiocarbonyl;

The dyes of the second dye layer do not need to be capable of spectrally sensitizing a silver halide emulsion. It is preferable to have a positively charged dye present in the second layer and in some cases it is preferable to have both a positively and negatively charged dye present in the second layer.

The second dye (also referred to herein as the dye of the outer dye layer or antenna dye) can be, for example:

an oxonol dye of Formula IV:

Formula IV

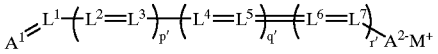

wherein $A^1$ and $A^2$ are ketomethylene or activated methylene moieties, $L^1$–$L^7$ are substituted or unsubstituted methine groups, (including the possibility of any of them being members of a five or six-membered ring where at least one and preferably more than one of p, q, or r is 1); $M^+$ is a cation, and p', q' and r' are independently 0 or 1;

an oxonol dye of Formulae IV-A or IV-B:

Formula IV-A

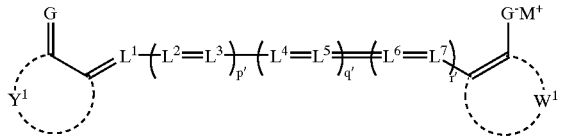

Formula IV-B

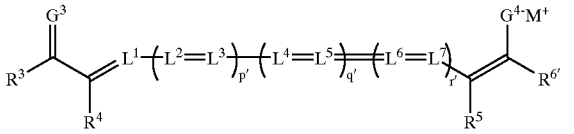

wherein $W^1$ and $Y^1$ are the atoms required to form a cyclic activated methylene/ketomethylene moiety; $R^3$ and $R^5$ are aromatic or heteroaromatic groups; $R^4$ and $R^6$ are electron-withdrawing groups; $G^1$ to $G^4$ is O or dicyanovinyl (—$C(CN)_2$)) and p', q', and r' are defined as above, and $L^1$ to $L^7$ are defined as above;

an oxonol dye of Formula V

Formula V

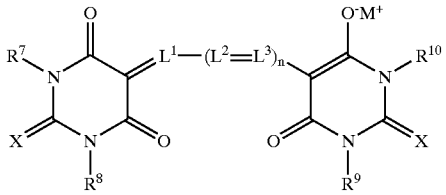

wherein X is oxygen or sulfur; $R^7$–$R^{10}$ each independently represent an unsubstituted or substituted alkyl group, an unsubstituted or substituted aryl group or an unsubstituted or substituted heteroaryl group; $L^1$, $L^2$ and $L^3$ each independently represent substituted or unsubstituted methine groups; $M^+$ represents a proton or an inorganic or organic cation; and n is 0, 1, 2 or 3;

a merocyanine of Formula VI:

Formula VI

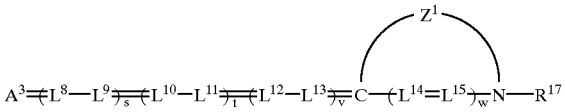

wherein $A^3$ is a ketomethylene or activated methylene moiety as described above; each $L^8$ to $L^{15}$ are substituted or unsubstituted methine groups (including the possibility of any of them being members of a five or six-membered ring where at least one and preferably more than 1 of s, t, v or w is 1); s, t, v, and w are independently 0 or 1, $Z^1$ represents the non-metallic atoms necessary to complete a substituted or unsubstituted ring system containing at least one 5 or 6-membered heterocyclic nucleus; $R^{17}$ represents a substituted or unsubstituted alkyl, aryl, or aralkyl group;

a merocyanine dye of Formula VII-A:

Formula VII-A

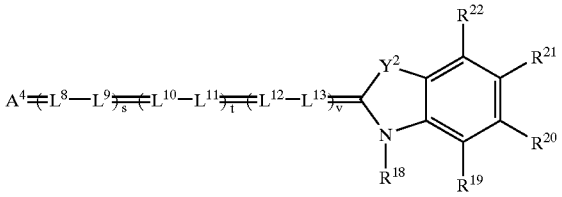

wherein $A^4$ is an activated methylene moiety or a ketomethylene moiety as described above, $R^{18}$ is substituted or unsubstituted aryl, alkyl or aralkyl, $R^{19}$ to $R^{22}$ each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings,; $L^8$ through $L^{13}$ are substituted or unsubstituted methine groups as, $Y^2$ is O, S, Te, Se, $NR_x$, or $CR_yR_z$ (where Rx, Ry and Rz are alkyl groups with 1–5 carbons), and s and t and v are independently 0 or 1;

a merocyanine dye of Formula VIII-A:

VIII-A

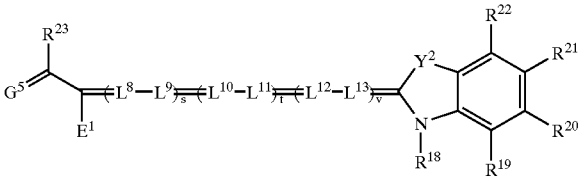

wherein $R^{23}$ is a substituted or unsubstituted aryl, heteroaryl, or a substituted or unsubstituted amino group; $G^5$ is O or dicyanovinyl ($C(CN)_2$), $E^1$ is an electron-withdrawing group, $R^{18}$ to $R^{22}$, $L^8$ to $L^{13}$, $Y^2$, and s, t and v are as described above;

a dye of Formula VIII-B:

VIII-B

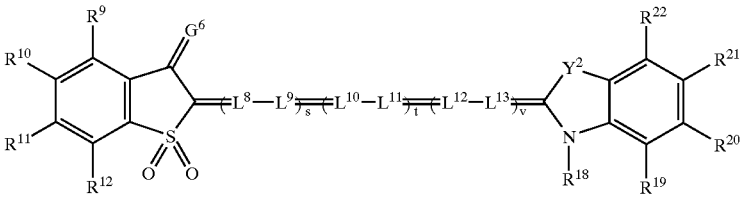

wherein $G^6$ is oxygen (O) or dicyanovinyl ($C(CN)_2$), $R^9$ to $R^{12}$ groups each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings and $R^{18}$, $R^{19}$ through $R^{22}$, $Y^2$, $L^8$ through $L^{13}$, and s, t and v are as described above, a dye of Formula VIII-C:

VIII-C

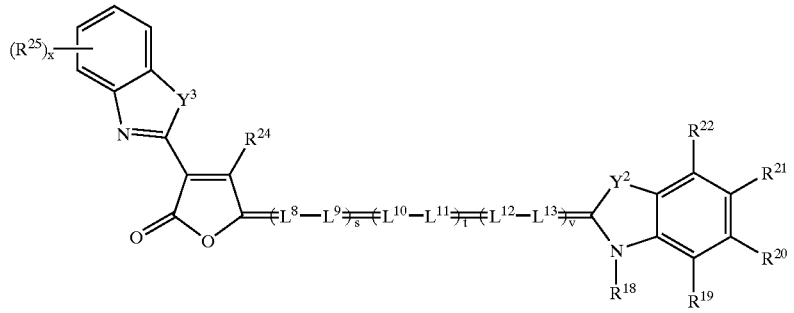

wherein $R^{25}$ groups each individually represent the groups described for $R^{19}$ through $R^{22}$ above, $Y^3$ represents O, S, $NR_x$, or $CR_yR_z$(where Rx, Ry and Rz are alkyl groups with 1–5 carbons), x is 0, 1, 2, 3 or 4, $R^{24}$ represents aryl, alkyl or acyl, and $Y^2$, $R^{18}$, $R^{19}$ through $R^{22}$, $L^8$ through $L^{13}$, and, s, t and v are as described above;

a dye of Formula VIII-D:

VIII-D

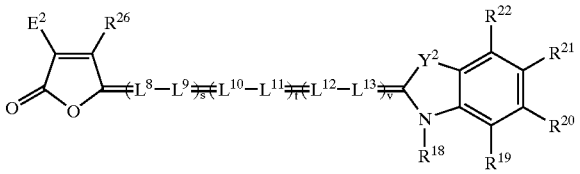

wherein $E^2$ represents an electron-withdrawing group, preferably cyano, $R^{26}$ represents aryl, alkyl or acyl, and $Y^2$, $R^{18}$, $R^{19}$ through $R^{22}$, $L^8$ through $L^{13}$, and, s, t and v are as described above;

a dye of Formula VIII-E:

VIII-E

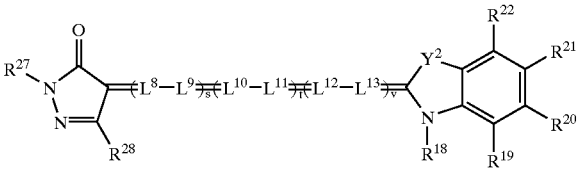

wherein $R^{27}$ is a hydrogen, substituted or unsubstituted alkyl, aryl or aralkyl, $R^{28}$ is substituted or unsubstituted alkyl, aryl or aralkyl, alkoxy, amino, acyl, alkoxycarbonyl, carboxy, carboxylate, cyano, or nitro; $R^{18}$ to $R^{22}$, $L^8$ to $L^{13}$, $Y^2$, and s, t and v are as described above;

a dye of Formula VIII-F:

VIII-F

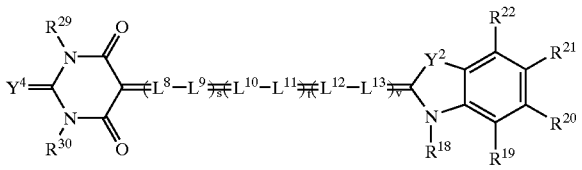

wherein $R^{29}$ and $R^{30}$ are each independently a hydrogen, substituted or unsubstituted alkyl, aryl or aralkyl, $Y^4$ is O or S, $R^{18}$ to $R^{22}$, $L^8$ to $L^{13}$, $Y^2$, and s, t and v are as described above;

a dye of Formula IX:

Formula IX

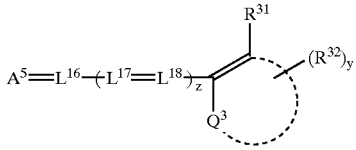

wherein $A^5$ is a ketomethylene or activated methylene, $L^{16}$ through $L^{18}$ are substituted or unsubstituted methine, $R^{31}$ is alkyl, aryl or aralkyl, $Q^3$ represents the non-metallic atoms necessary to complete a substituted or unsubstituted ring system containing at least one 5- or 6-membered heterocyclic nucleus, $R^{32}$ represents groups as described above for $R^{19}$ to $R^{22}$, y is 0, 1, 2, 3 or 4, z is 0, 1 or 2;

a dye of Formula X:

Formula X

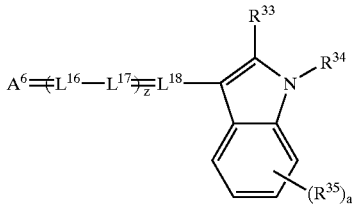

wherein $A^6$ is a ketomethylene or activated methylene, $L^{16}$ through $L^{18}$ are methine groups as described above for L1 through $L^7$, $R^{33}$ is substituted or unsubstituted alkyl, aryl or aralkyl, $R^{34}$ is substituted or unsubstituted aryl, alkyl or aralkyl, $R^{35}$ groups each independently represent groups as described for $R^{19}$ through $R^{22}$, z is 0, 1 or 2, and a is 0, 1, 2, 3 or 4;

a dye of Formula XI:

Formula XI

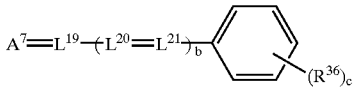

wherein $A^7$ represents a ketomethylene or activated methylene moiety, $L^{19}$ through $L^{21}$ represent methine groups as described above for $L^1$ through $L^7$, $R^{36}$ groups each individually represent the groups as described above for $R^{19}$ through $R^{22}$, b represents 0 or 1, and c represents 0, 1, 2, 3 or 4;

a dye of Formula XII:

Formula XII

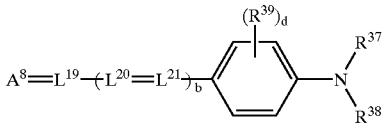

wherein $A^8$ is a ketomethylene or activated methylene, $L^{19}$ through $L^{21}$ and b are as described above, $R^{39}$ groups each individually represent the groups as described above for $R^{19}$ through $R^{22}$, and $R^{37}$ and $R^{38}$ each individually represent the groups as described for $R^{18}$ above, and d represents 0, 1, 2, 3 or 4;

a dye of Formula XIII:

Formula XIII

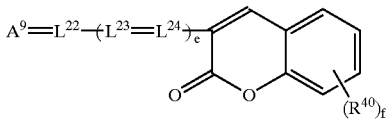

wherein $A^9$ is a ketomethylene or activated methylene moiety, $L^{22}$ through $L^{24}$ are methine groups as described above for $L^1$ through $L^7$, e is 0 or 1, $R^{40}$ groups each individually represent the groups described above for $R^{19}$ through $R^{22}$, and f is 0, 1, 2, 3 or 4;

a dye of Formula XIV:

Formula XIV

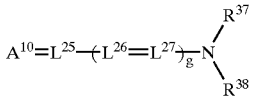

wherein $A^{10}$ is a ketomethylene or activated methylene moiety, $L^{25}$ through $L^{27}$ are methine groups as described above for $L^1$ through $L^7$, g is 0, 1 or 2, and $R^{37}$ and $R^{38}$ each individually represent the groups described above for $R^{18}$;

a dye of Formula XV:

Formula XV

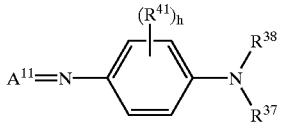

wherein $A^{11}$ is a ketomethylene or activated methylene moiety, $R^{41}$ groups each individually represent the groups described above for $R^{19}$ through $R^{22}$, $R^{37}$ and $R^{38}$ each represent the groups described for R18, and h is 0, 1, 2, 3, or 4;

a dye of Formula XVI:

$$Q^4—N=N—Q^5$$ Formula XVI wherein $Q^4$ and $Q^5$ each represents the atoms necessary to form at least one heterocyclic or carbocyclic, fused or unfused 5 or 6-membered-ring conjugated with the azo linkage.

Dyes of Formula IV–XVI above are preferably substituted with either a cationic or an anionic group.

Particularly preferred as dyes for the second layer are antenna dyes having structure XVII

XVII

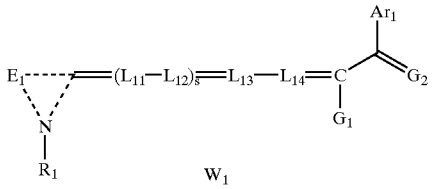

wherein:

$R_1$ is a substituted or unsubstituted alkyl or aryl group; $E_1$ represents the atoms necessary to complete a substituted or unsubstituted 5- or 6-membered heterocyclic nucleus; $Ar_1$ is a substituted or unsubstituted aryl or a substituted or unsubstituted heteroaryl group; $L_{11}$ through $L_{14}$ are substituted or unsubstituted methine groups; s is 0 or 1; $G_1$ is an electron-withdrawing group; $G_2$ is O or dicyanovinyl ($C(CN)_2$); $W_1$ is a counterion if necessary. In one preferred embodiment at least one substituent on the dye of Formula XVII is a cationic or can be protonated to become a cationic substituent.

Also preferred as dyes for the second layer are antenna dyes having structure XVIII

XVIII

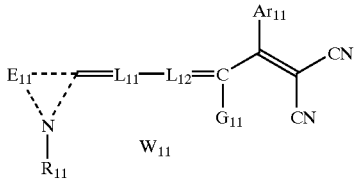

wherein:

$E_{11}$ represents the atoms necessary to complete a substituted or unsubstituted 5- or 6-membered heterocyclic nucleus. These include a substituted or unsubstituted: thiazole nucleus, selenazole nucleus, quinoline nucleus, tellurazole nucleus, pyridine nucleus, imidazole nucleus, or thiadiazole nucleus. The heterocyclic nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art, or the heterocycle may be fused to another aromatic or heteroaromatic ring, e.g benzothiazole, naphtohselenazole, thiazolopyridine, imidazoquinoxazline, etc.

$Ar_{11}$ is a substituted or unsubstituted aryl or a substituted or unsubstituted heteroaryl group, for example $R_{22}$ can be phenyl or 2-pyridyl.

$R_{11}$ is a substituted or unsubstituted alkyl or aryl group;

$L_{11}$ and $L_{12}$ are substituted or unsubstituted methine groups, $W_{11}$ is a counterion if necessary.

In one preferred embodiment at least one substituent on the dye of Formula XVIII is a cationic or can be protonated to become a cationic substituent. In another preferred embodiment $E_{11}$ represents the atoms necessary to complete a substituted or unsubstituted benzothiazole nucleus, or quinoline nucleus. $R_{11}$ is represented by:

—(L)—T where L is a substituted or unsubstituted linking group that is at least 2 atoms long and T is a group having a charge of +1 or greater. In another preferred embodiment L is at least 3 atoms long and more preferably at least 4 atoms long.

In another preferred embodiment the second dye is of Formula XVIII-A:

XVIII-A

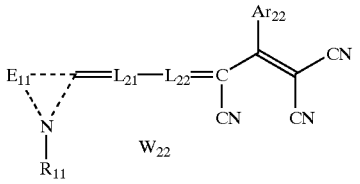

wherein:

$E_{11}$ represents the atoms necessary to complete a substituted or unsubstituted benzothiazole nucleus, a substituted or unsubstituted benzoxazole nucleus, a substituted or unsubstituted benzoselenazole nucleus, a substituted or unsubstituted pyridne nucleus, a substituted or unsubstituted quinoline nucleus, a substituted or unsubstituted benzotellurazole nucleus, a substituted or unsubstituted benzimidazole nucleus, or a substituted or unsubstituted indole nucleus;

$Ar_{22}$ is a substituted or unsubstituted aryl or a substituted or unsubstituted heteroaryl group;

$R_{11}$ is a substituted alkyl or aryl group containing a cationic substituent;

$L_{21}$ and $L_{22}$ are substituted or unsubstituted methine groups;

$W_{22}$ is one or more ions as needed to balance the charge on the molecule.

In this embodiment of the invention, the "photographic material" further comprises a third dye of Formula XVIII-B:

XVIII-B

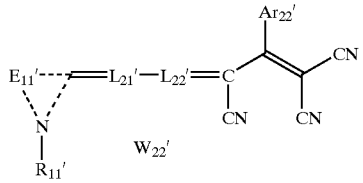

wherein:

$E_{11}'$ represents the atoms necessary to complete a substituted or unsubstituted benzothiazole nucleus, a substituted or unsubstituted benzoelenazole nucleus, a substituted or unsubstituted quinoline nucleus, a substituted or unsubstituted benzotellurazole nucleus, a substituted or unsubstituted pyridnine, or a substituted or unsubstituted indole nucleus;

$Ar_{22}'$ represents a substituted or unsubstituted aryl or a substituted or unsubstituted heteroaryl group;

$R_{11}'$ represents a substituted or unsubstituted alkyl or aryl group containing n anionic substituent;

$L_{21}'$ and $L_{22}'$ represent substituted or unsubstituted methine groups;

$W_{22}'$ represents one or more ions as needed to balance the charge on the molecule. Particularly preferred dyes of Formula XVIIIb:

$E_{11}'$ represents the atoms necessary to complete a substituted or unsubstituted benzothiazole nucleus, or quinoline nucleus.

$R_{11}'$ is represented by:

—(L')—T' where L' is a substitued or unsubstituted linking group that is at least 2 atoms long and T' is a group having a charge of +1 or greater.

In another preferred embodiment dyes for the second layer are dyes having structure XIX:

XIX

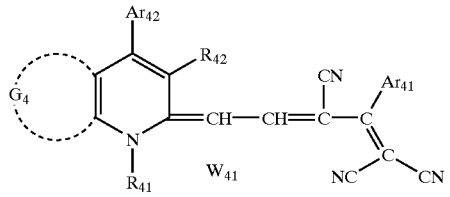

wherein:

$R_{41}$ represents a substituted or unsubstituted alkyl group;

$R_{42}$ represents a hydrogen, a substituted or unsubstituted alkyl group, a substituted or unsubstituted aromatic group, or a halogen;

$G_4$ represents represent the atoms necessary to complete a substituted or unsubstituted benzene which may be fused to other rings;

$Ar_{41}$ and $Ar_{42}$ independently represent a substituted or unsubstituted aryl or heteroaryl group which may have fused rings;

$W_{41}$ is a counterion if necessary.

In the above preferred embodiment at least one substituent on the dye is cationic or can be protonated to become a cationic substituent. Examples of positively charged substituents are 3-(trimethylammonio)propyl), 3-(4-ammoniobutyl), 3-(4-guanidinobutyl) etc. Other examples are any substituents that take on a positive charge in the silver halide emulsion melt, for example, by protonation such as aminoalkyl substituents, e.g. 3-(3-aminopropyl), 3-(3-dimethylaminopropyl), 4-(4-methylaminopropyl), etc.

In another preferred embodiment the second dye is of Formula XX:

XX

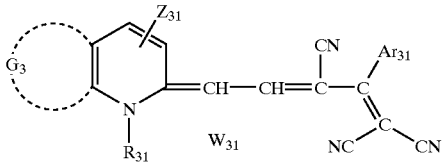

wherein:

$R_{31}$ represents a substituted alkyl group;

$Z_{31}$ represents a hydrogen, a halogen, a cyano group, a substituted or unsubstituted alkyl group, a substituted or unsubstituted aryl group, a substituted or unsubstituted heteroaryl group, an aminoalkyl group, a carbamoyl group, or a fused aromatic ring;

$G_3$ represents represent the atoms necessary to complete a substituted or unsubstituted benzene which may be fused to other rings, $Ar_{31}$ represents a substituted or unsubstituted aryl or a substituted or unsubstituted heteroaryl group and $Ar_{31}$ may have fused rings;

$W_{31}$ is one or more ions as needed to balance the charge on the molecule.

In another preferred embodiment the second dye is of Formula XXI:

XXI

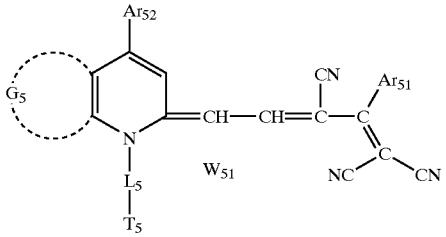

wherein:

$L_5$ represents a substituted or unsubstituted alkyl group having at least 3 carbon atoms;

$T_5$ represents a substituted or unsubstituted ammonium group, guanidinium group, or amidinium group;

$G_5$ represents the atoms necessary to complete a substituted or unsubstituted benzene which may be fused to other rings, $Ar_{51}$ and $Ar_{52}$ independently represent a substituted or unsubstituted aryl or heteroaryl groups which may have fused rings;

$W_{51}$ is one or more ions as needed to balance the charge on the molecule.

In this embodiment of the invention, the photographic material preferably further comprises a third dye of Formula XXI-A:

XXI-A

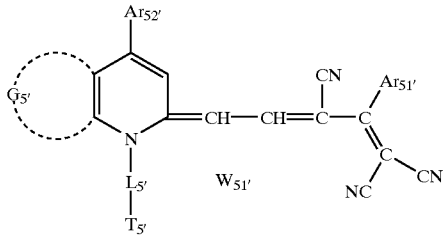

wherein:

$L_5'$ represents a substituted or unsubstituted alkyl group having at least 2 carbon atoms;

$T_5'$ represents a group having a negative charge;

$G_5'$ represents the atoms necessary to complete a substituted or unsubstituted benzene which may be fused to other rings, $Ar_{51}'$ and $Ar_{52}'$ independently represent a substituted or unsubstituted aryl or substituted or unsubstituted heteroaryl groups and $Ar_{51}'$ and $Ar_{52}'$ may have fused rings;

$W_{51}'$ is one or more ions as needed to balance the charge on the molecule.

In certain cases, invention dyes which have an anionic substituent rather than a cationic substituent can be added to the photographic element and are useful for stabilizing the second dye layer. Examples of negatively charged substituents are 3-sulfopropyl, 2-carboxyethyl, 4-sulfobutyl, etc.

In another preferred embodiment, the second dye has a solubility in aqueous media of less than 1, preferably less than 0.5 and more preferably less than 0.3% by weight.

In yet another preferred embodiment, the second dye forms a liquid-crystalline phase in solvent such as an aqueous media, including hydrophilic colloids, when dispersed as described herein.

The dispersions of this invention can be prepared in any of the ways known in the art (e.g., with the aid of a high-boiling non-polar organic solvent or in suitable water-miscible solvents such as methyl alcohol or dimethylformamide or the like), but are preferably formulated using methods developed for producing solid microcrystalline particles of dye (SPD's) or are more preferably formulated as direct gelatin dispersions (DGD's) as described herein.

The liquid-crystalline dispersions of this invention may be prepared by well-known methods commonly employed for preparing solid particle dispersions. Such methods includes forming a slurry of the dye in an aqueous medium comprising water and a surfactant and the subjecting the slurry to a milling procedure such as ball-milling, sand-milling, media-milling or colloid-milling (preferably media-milling). The dye slurry can then be added to an aqueous medium comprising water and a hydrophilic colloid, such as gelatin, for use in a photographic element.

In another preferred embodiment, the dyes may be formulated as a direct gelatin dispersion (DGD) wherein the finely powdered dye or aqueous slurry thereof is simply mixed or agitated with water or with an aqueous medium containing gelatin (or other hydrophilic colloid) at a temperature of 0–100° C. This method does not require the use of organic solvents, surfactants, polymer additives, milling processes, pH control or the like. It is simpler, faster, more forgiving and more flexible than prior processes.

In either of the preferred methods, the dyes may be subjected to elevated temperatures before and/or after gelatin dispersion, but to obtain desirable results, this heat treatment is carried out preferably after dispersing in gelatin. The optimal temperature range for preparing gelatin-based dispersions is 20° C.–100° C., depending on the concentration of the gelatin, but should remain below the decomposition points of the dyes. The heating time is not especially critical as long as the dyes are not decomposed, but in general it is in the range of 5 minutes to 48 hours. A similar heat treatment may be applied, if so desired, to dyes prepared as solid particle dispersions before and/or after dispersion in aqueous gelatin to obtain effective results. Furthermore, if so desired, pH and/or ionic strength adjustments may be utilized to control the solubility and aggregation properties of dyes prepared using SPD or DGD formulation techniques. The direct gelatin dispersion method is advantageous in that it does not necessarily require the use of organic solvents, surfactants, polymer additives, milling processes, pH control or the like. A related method described by Boettcher for preparing concentrated sensitizing dye dispersions in aqueous gelatin (PCT WO 93/23792) is equally effective when applied to the inventive dyes. The entire disclosure of WO 93/23792 is incorporated herein by reference. The liquid crystalline dye dispersions useful in this invention may be incorporated directly into imaging elements, or may be microencapsulated prior to final incorporation.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Particularly preferred dyes for use in accordance with this invention are given in Table I, however the dyes useful in the invention are not limited to these compounds. Examples of dyes useful as antenna dyes are designated by prefix I in Table I. As discussed previously, it is sometimes valuable to add a third dye having an anionic substituent to aid in the stabilization of the antenna dye layer. Examples of these types of dyes are designated by prefix II in Table I.

TABLE 1

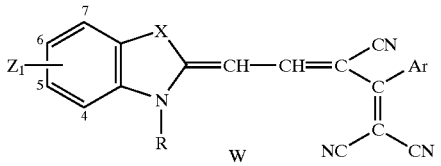

| Dye | X | R | $Z_1$ | Ar | W |
|---|---|---|---|---|---|
| I-1 | S | $—(CH_2)_5N(Me)_3^+$ | 5-Ph | 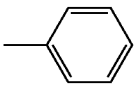 | $Br^-$ |
| I-2 | S | $—(CH_2)_5N(Et)_3^+$ | 5-Ph | 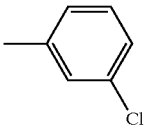 | $Br^-$ |
| I-3 | S | $—(CH_2)_5N(Me)_3^+$ | 5-Ph | 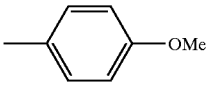 | $Br^-$ |
| I-4 | S | $—(CH_2)_5N(Me)_3^+$ | 5-Ph | 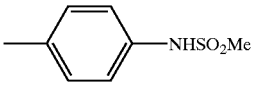 | $MeSO_3^-$ |
| I-5 | 5 | $—(CH_2)_5N(Me)_2Et^+$ | 5-Ph | 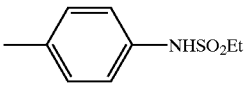 | $Br^-$ |

TABLE 1-continued

| | | | | | |
|---|---|---|---|---|---|
| I-6 | S | $—(CH_2)_5N(Et)_3^+$ | 5-Cl | | $Br^-$ |
| I-7 | S | $—(CH_2)_5N(Me)_2Bu^+$ | 5-Cl | $NHSO_2Me$ | $MeSO_3^-$ |
| I-8 | S | $—(CH_2)_5N(Me)_3^+$ | 5-Me | $NHSO_2Me$ | $MeSO_3^-$ |
| I-9 | S | $—(CH_2)_5N(Me)_3^+$ | 5-Cl | $CO_2Me$ | $MeSO_3^-$ |
| I-10 | S | $—(CH_2)_5N(Me)_3^+$ | 4,5-Benzo | $NHSO_2Et$ | $MeSO_3^-$ |
| I-11 | S | $—(CH_2)_5N(Me)_3^+$ | 5-Ph | | $MeSO_3^-$ |
| I-12 | $C(Me)_2$ | $—(CH_2)_5N(Me)_3^+$ | 5,6-Benzo | $NHSO_2Me$ | $MeSO_3^-$ |
| I-13 | S | $—(CH_2)_4N(Me)_3^+$ | 5-Ph | | $Br^-$ |
| I-14 | S | $—(CH_2)_5N(Me)_3^+$ | 5-Cl | | $MeSO_3^-$ |
| I-15 | O | $—(CH_2)_3N(Me)_3^+$ | 5-Ph | | $MeSO_3^-$ |

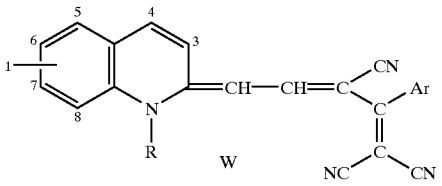

| Dye | R | $Z_1$ | Ar | W |
|---|---|---|---|---|
| I-16 | $—(CH_2)_5N(Me)_3^+$ | H | | $MeSO_3^-$ |
| I-17 | $—(CH_2)_5N(Me)_3^+$ | 7-Me | | $MeSO_3^-$ |

TABLE 1-continued

| | | | | |
|---|---|---|---|---|
| I-18 | $—(CH_2)_5N(Me)_3^+$ | 4-Ph | | $MeSO_3^-$ |
| I-19 | $—(CH_2)_5N(Me)_3^+$ | 6-OEt | | $MeSO_3^-$ |
| I-20 | $—(CH_2)_4N(Me)_3^+$ | 4-Ph | | $MeSO_3^-$ |
| I-21 | $—(CH_2)_4N(Me)_2(CH_2)_2OH^+$ | 4-Ph | | $MeSO_3^-$ |
| I-22 | $—(CH_2)_4N(Me)_2(CH_2)_2O(CH_2)_2OH^-$ | 4-Ph | | $MeSO_3^-$ |
| I-23 | $—(CH_2)_4N(Me)_2(CH_2)_2OH^-$ | 4-Ph | | $MeSO_3^-$ |
| II-1 | $—(CH_2)_3SO_3^-$ | 4-Ph | | $Et_3NH^-$ |
| II-2 | $—(CH_2)_3SO_3^-$ | 4-Ph | OMe | $Na^+$ |
| II-3 | $—(CH_2)_3SO_3^-$ | 4-Ph | Cl | $Na^+$ |

| Dye | X | R | $Z_1$ | Ar | W |
|---|---|---|---|---|---|
| II-4 | S | $—(CH_2)_3SO_3^-$ | 5-Ph | Cl | $Et_3NH^+$ |
| II-5 | O | $—(CH_2)_2SO_3^+$ | 5-Ph | | $Et_3NH^-$ |

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed. Tabular grain silver halide emulsions may also be used.

The silver halide grains to be used in the invention may be prepared according to methods known in the art, such as those described in *Research Disclosure I* and *The Theory of the Photographic Process*, $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dyes may, for example, be added as a solution or dispersion in water or an alcohol, aqueous gelatin, alcoholic aqueous gelatin, etc. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in *The Theory of the Photographic Process*, $4^{th}$ edition, T. H. James, editor, Macmillan Publishing Co., New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(α-(methanesulfonamido) ethylaniline sesquisulfate hydrate, 4-amino-3-methyl-N-ethyl-N-(α-hydroxyethyl)aniline sulfate, 4-amino-3-α-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

Example of Dye Synthesis

Quaternary salt intermediates and dyes were prepared by standard methods such as described in Hamer, *Cyanine Dyes and Related Compounds*, 1964 (publisher John Wiley & Sons, New York, N.Y.) and *The Theory of the Photographic Process*, $4^{th}$ edition, T. H. James, editor, Macmillan Publishing Co., New York, 1977. For example, (3-Bromopropyl)trimethylammonium bromide was obtained from Aldrich. The bromide salt was converted to the hexafluorophosphate salt to improve the compounds solubility in valeronitrile. Reaction of a dye base with 3-(bromopropyl)trimethylammonium hexafluorophosphate in valeronitrile at 135° C. gave the corresponding quaternary salt. For example, reaction of 2-methyl-5-phenylbenzoxazole with 3-(bromopropyl) trimethylammonium hexafluorophosphate gave 2-methyl-5-phenyl-(3-(trimethylammonio)propyl)benzoxazolium bromide hexafluorophosphate. Which could be converted to the bis-bromide salt with tetrabutylammonium bromide. Dyes were prepared from quaternary salt intermediates. For example, see the procedures in U.S. Pat. No. 5,213,956.

Examples of Fluorescence Properties of Dyes

The fluorescence quantum efficiency of the antenna dyes were measured according to the following procedure. Dyes were dispersed in 3% aqueous gelatin at a concentration of 1 mmol/mol Ag. At this concentration, the dyes that were examined were in an aggregated state.

Quinine sulfate was used as a standard. This standard, when prepared in 1N sulfuric acid and excited above 330 nm at room temperature (25 C.), has a known quantum efficiency of 0.55 (W. H. Melhuish, *J. Phys. Chem.*, 65, 229 (1961)). The quinine sulfate solution was prepared at a concentration of $\sim 5\times10^{-3}$ M which enabled the absorbance to be ~0.07 at 350 nm. Each sample was contained in a 0.01 mm demountable Spectrosil cell. Measurements were made at room temperature.

A diode array spectrometer with a dispersive optical configuration was employed for absorption measurements. The system is comprised of an irradiance source, a sample compartment, a dispersive element and a photodiode array detector. A cell holder designed to accommodate cell types with short pathlengths was used for this study to ensure consistent orientation of the cell in relation to the beam path.

For fluorescence measurements, the sample dyes and standard were excited into the first singlet state by the radiation from a 450W xenon lamp source. The wavelengths used to excite the samples (λ) have a high enough energy so that a full emission spectrum for the samples and the standard could be obtained without interference from Rayleigh scattered source light. For each dye in its aggregated state the excitation wavelength (λ) was chosen so that any interference from the monomer of the dye was minimized. The xenon beam was focused into the excitation double monochromator which contained holographic gratings blazed at 350 nm. Fluorescence from the samples was collected at a 22 degree angle and focused into the emission monochromator which contained holographic gratings blazed at 500 nm. The spectrometer slits were set at 2.0 mm (3.6 nm bandwidth). A red sensitive (Hamamatsu R928P) photomultiplier detector (cooled) was used; photon counting signal methods were employed.

The fluorescence quantum efficiency of a dye ($Q_D$) was determined by the equation given below and the results are listed in Table A.

$$Q_D=Q_S({}^AS/A_D)({}^PS/P_D)({}^ID/I_S)({}^\eta D/\eta_S)^2$$

Where:

$Q_D$=Quantum efficiency of the dye (in 3% aqueous gel)

$Q_S$=Quantum efficiency, quinine sulfate solution, assumed $A_S$=Absorbance of the standard at 350 nm $A_D$=Absorbance of the dye at wavelength λ

$P_S$=Incident Power for excitation of the standard at 350 nm $P_D$=Incident Power for excitation of the dye at wavelength λ

$I_S$=Integrated Area of standard $I_D$=Integrated Area of the dye emission spectrum $\eta_D$=Index of refraction, 3% gel aqueous solution at λ

$\eta_S$=Index of refraction, quinine sulfate in water at 350 nm

TABLE A

Spectroscopic Parameters and Fluorescence Quantum Efficiencies for Antenna Dyes at 1 mmolar concentration in 3% gelatin solution.

| Antenna Dye | Absorption $\lambda_{max}$ (nm) | $\lambda_{max}$ Absorbance | Fluorescence $\lambda_{max}$ (mn) | Fluorescence Quantum Efficiency |
|---|---|---|---|---|
| I-1 | 587 | 0.175 | 594 | 0.031 |
| I-2 | 604 | 0.410 | 609 | 0.110 |
| I-6 | 592 | 0.293 | 597 | 0.027 |
| I-9 | 623 | 0.573 | 630 | 0.047 |
| I-14 | 626 | 0.390 | 631 | 0.055 |
| I-15 | 549 | 0.35 | 557 | 0.126 |
| I-20 | 625 | 0.33 | 629 | 0.109 |
| II-1 | 623 | 0.25 | 627 | 0.050 |
| II-3 | 627 | 0.235 | 642 | 0.147 |
| CD-1 | 627 | 0.176 | 638 | 0.042 |
| CD-2 | 608 | 0.148 | 619 | 0.040 |
| CD-3 | 636 | 0.108 | 643 | 0.031 |
| CD-4 | 614 | 0.188 | 638 | 0.010 |
| CD-5 | 617 | 0.220 | 630 | 0.014 |
| CD-6 | 602 | 0.153 | 613 | 0.0096 |
| CD-7 | 612 | 0.147 | 658 | 0.0085 |
| CD-8 | 637 | 0.16 | 642 | 0.069 |
| CD-9 | 590 | 0.280 | 604 | 0.015 |
| CD-10 | 597 | 0.070 | 616 | 0.050 |

To be considered highly fluorescent for this invention, an antenna dye must have fluorescence quantum yields above 0.02, and preferably above 0.05 for the state of the dye that has fluorescence wavelengths that overlap the absorption wavelengths of the inner dye layer. In addition, to be considered highly fluorescent for this invention, an antenna dye must have much of its population in the state having the fluorescence wavelengths that overlap the absorption wavelengths of the inner dye layer. For example, if the state of the dye is the J-aggregate that has the fluorescence wavelengths that overlap the absorption wavelengths of the inner dye layer, then much of the dye must be in the J-aggregate state, as opposed to undissolved solid particles or dye in the monomeric state that would have fluorescence at shorter wavelengths than the J-aggregate. A fitness for use test to determine if a dye meets this latter criterion is to measure the absorbance of the desired fluorescent species in a dye sample at 1 mmolar concentration in 3% aqueous gelatins solution. The 3% gelatin solution approximates the emulsion environment. The fluorescent species in a dye sample prepared at 1 mmolar concentration in 3% gelatin solution preferably should have an absorbance of about 0.2 or greater, and more preferably above 0.3 when measured in a 0.01 mm pathlength cell.

Comparison Dyes

CD-1

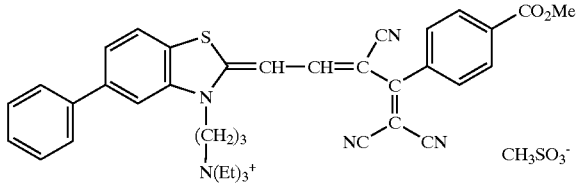

CD-2

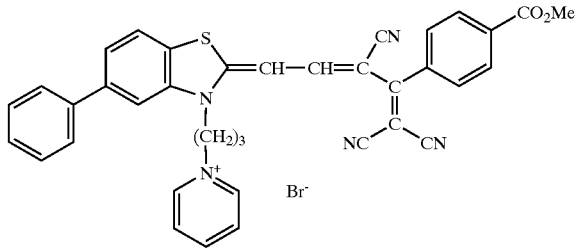

CD-3

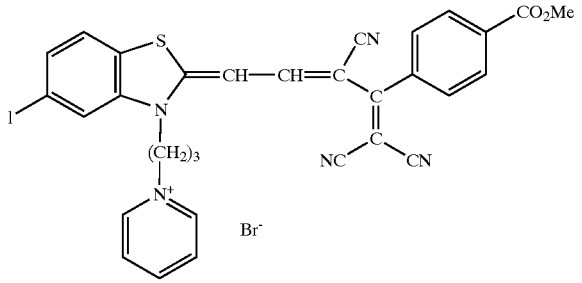

CD-4

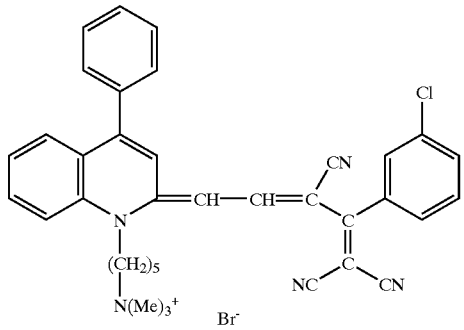

-continued

CD-5

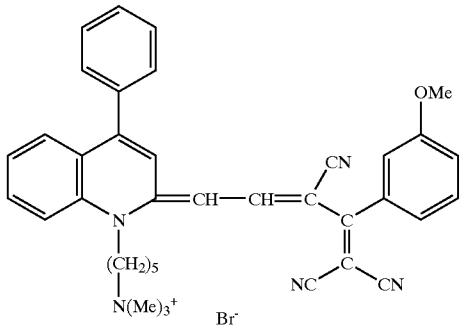

CD-6

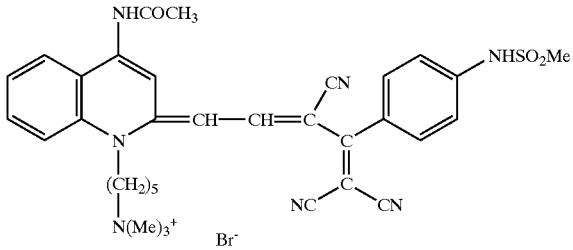

CD-7

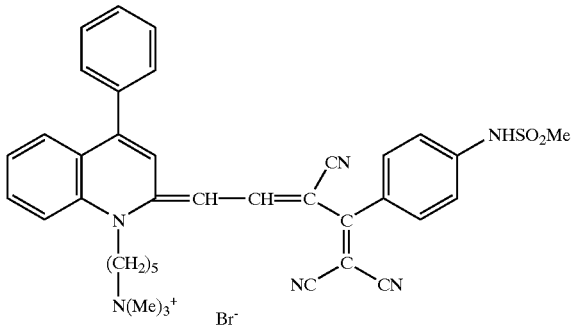

CD-8

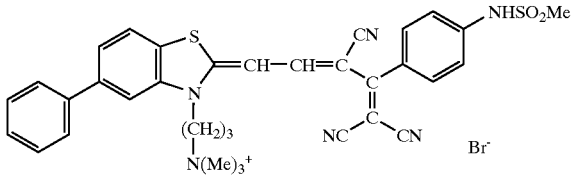

CD-9

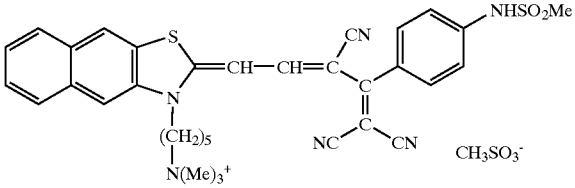

CD-10

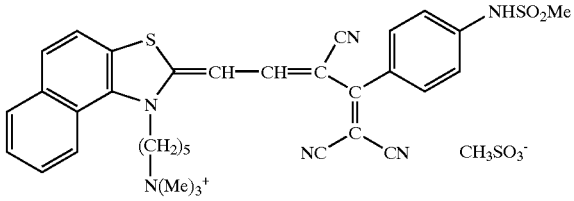

Photographic Evaluation—Example 1

A silver iodobromide tabular emulsion containing 3.6 mol % iodide was precipitated by methods described in Fenton, et al., U.S. Pat. No. 5,476,760. Briefly, the first 70% of silver was precipitated as silver bromide. Then KI was added in an amount to give 3.6% of the final total silver, followed by addition of $AgNO_3$ to complete the precipitation. The resulting silver iodobromide tabular grains had an average equivalent circular diameter of 3.9 $\mu$m and thickness of 0.11 $\mu$m. The emulsion contained tetrapotassium hexacyanoruthenate ($K_4Ru(CN)_6$, $5\times10^{-5}$ mole/mole Ag) as a dopant that was added between 66 and 67% of the silver halide precipitation. After washing by an ultrafiltration procedure, a portion of the emulsion was given an optimal conventional spectral and chemical sensitization according to the following procedure that was determined to give optimum sensitivity by prior experimentation. Sodium thiocyanate (120 mg/mol Ag) was added 40° C. followed by the conventional sensitizing dyes SD-1 (0.808 mmol/mol Ag), and SD-2 (0.202 mmol/mol Ag). After an additional 20 min at 40° C., a sulfur agent (N-(carboxymethyl-trimethyl-2-thiourea, sodium salt, 2.4 mg/mol Ag), a gold salt (bis(1,3,5-trimethyl-1,2,4-triazolium-3-thiolate) gold(I) tetrafluoroborate, 2.0 mg/mol Ag), and an antifoggant (3-(3-((methylsulfonyl)amino)-3-oxopropyl)-benzothiazolium tetrafluoroborate), 45 mg/Ag mole) were added at intervals of 5 min. The emulsion was then heated to 60° C. and held for 20 min. After cooling back to 40° C., 1-(3-acetamidophenyl)-5-mercaptotetrazole was added (compound A2, 114 mg/mol Ag). The antenna dyes (see Table II), when present, were added to the melt and held for 20 min at 40° C.

SD-1

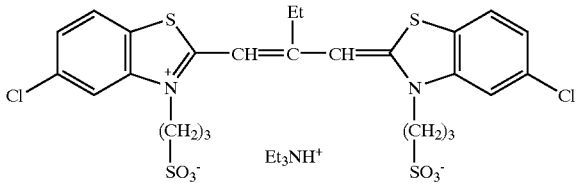

SD-2

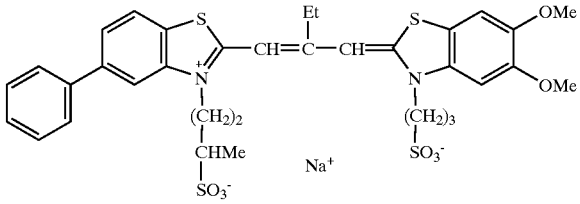

The resulting emulsion samples were then coated on cellulose acetate film support with an antihalation backing. The coatings contained 1.08 g Ag/m$^2$, 1.61 g gelatin/m$^2$, 4-hydroxy-6-methyl-1,3,3a,7-tetraazaindene stabilizer (1 g/mol Ag), and surfactants. A protective gelatin overcoat containing hardener was applied over the emulsion layer.

The dried coatings were given a 365 nm Hg-line exposure or a 5500K daylight exposure for 0.01 sec through a step tablet ranging in optical density from 0 to 4. The daylight exposure was additionally filtered with a Wratten No. 9 filter to remove blue light (wavelengths>480 nm transmitted). The exposed strips were developed for 6 min in the KODAK Rapid X-ray process.

Photographic sensitivity was determined by the exposure in lux-seconds that was required to produce upon development an optical density of 0.15 above the minimum density. The sensitometric results are given in Table II below the sensitivity to a 365 nm Hg-line exposure is known as the intrinsic sensitivity. The ratio of spectral to intrinsic sensitivity is defined as the ratio of the filtered daylight sensitivity to the intrinsic sensitivity. The spectral to intrinsic sensitivity ratios in Table II and in subsequent examples were further normalized to that of the control emulsion sample that was optimally sensitized with the conventional first sensitizing dyes but contained no dye added as antenna dye.

TABLE II

Sensitometric evaluation of antenna dyes in Photographic Example 1.

| Example[a] | Antenna Dye | Level[b] | $D_{min}$ | IS[c] | DL[d] | DL/IS Ratio[e] | Relative DL/IS[f] |
|---|---|---|---|---|---|---|---|
| 1-1, C | None | — | 0.05 | 398 | 537 | 1.349 | 100 |
| 1-2, C | CD-1 | 1.0 | 0.09 | 263 | 295 | 1.122 | 83 |
| 1-3, C | CD-2 | 1.5 | 0.09 | 302 | 257 | 0.851 | 63 |
| 1-4, C | CD-3 | 1.0 | 0.05 | 174 | 166 | 0.9538 | 71 |
| 1-5, I | I-1 | 1.0 | 0.08 | 123 | 214 | 1.738 | 129 |
| 1-6, I | I-6 | 1.0 | 0.07 | 178 | 295 | 1.658 | 123 |
| 1-7, I | I-2 | 1.0 | 0.09 | 83.2 | 129 | 1.548 | 115 |
| 1-8, I | I-3 | 1.0 | 0.10 | 126 | 229 | 1.818 | 135 |
| 1-9, I | I-9 | 1.5 | 0.10 | 170 | 174 | 1.022 | 76 |
| 1-10, I | I-16 | 1.5 | 0.07 | 138 | 214 | 1.549 | 115 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 9 filter) to simulate a daylight exposure.
[e]DL/IS is the ratio of the daylight sensitivity to the intrinsic sensitivity.
[f]Relative DL/IS is the DL/IS ratio normalized relative to the comparison dye.

It can be seen from Table II that the highly florescent invention antenna dyes (see Table A) give enhanced spectral speed whereas the comparison antenna dyes do not.

Photographic Evaluation—Example 2

The emulsion of Example 1 was chemically and spectrally sensitized in the same manner as described in Example 1, except that the level of the sulfur sensitizer (carboxymethyl-trimethyl-2-thiourea, 2.1 mg/mole Ag) was slightly reduced. Antenna dyes were then added to aliquots of the sensitized emulsion at 40° C. and held 20 min. In the case where a second antenna dye was added, there was a 20 min hold at 40° C. after each dye addition.

Coating, was carried out as described for Photographic Example 1 except the silver laydown was reduced to 0.538 g/m$^2$. The dried coatings were exposed and processed as in Example 1. The sensitometric results are listed in Table III.

TABLE III

Sensitometric evaluation of antenna dyes in Example 2.

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 2-1, C | None | — | None | — | 0.03 | 309 | 363 | 1.18 | 100 |
| 2-2, I | I-20 | 1.5 | None | — | 0.06 | 200 | 363 | 1.82 | 154 |
| 2-3, I | I-20 | 1.5 | II-1 | 1.5 | 0.07 | 224 | 457 | 2.04 | 173 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 9 filter) to simulate a daylight exposure.
[e]DL/IS is the ratio of the daylight sensitivity to the intrinsic sensitivity.
[f]Norm. DL/IS is the DL/IS ratio normalized relative to the comparison dye.

The data in Table III shows that spectral sensitivity may be enhanced by the addition of antenna dyes according to the invention. In particular, further spectral sensitivity enhancement may be achieved when a second antenna dye having opposite charge to the first antenna dye is added.

Photographic Evaluation—Example 3

A AgBrI emulsion containing ultrathin tabular grains having an average equivalent circular diameter of 1.95 $\mu$m and thickness of 0.067 $\mu$m was precipitated according to the formula given for emulsion D in Deaton et al, U.S. Pat. No. 5,582,965. This emulsion was given an epitaxial sensitization according to the procedure given for Sample E-2, except that the dyes consisted of SD-1 (1.359 mmol/mol Ag) and SD-2 (0.365 mmol/mol Ag). The spectrally and epitaxially sensitized emulsion was further given an optimal chemical sensitization by adding NaSCN (120 mg/mol Ag), carboxymethyl-trimethyl-2-thiourea (1.59 mg/mol Ag), bis(1,4,5-trimethyl-1,2,4-triazolium-3-thiolate) gold (I) tetrafluoroborate (0.855 mg/mol Ag), and 1-(3-acetamidophenyl)-5-mercaptoterazole (11.4 mg/mol Ag) and then raising the temperature to 50° C. and holding for 20 min before cooling back to 40° C. and adding additional 1-(3-acetamidophenyl)-5-mercaptoterazole (114 mg/mol Ag). Antenna dyes were added to aliquots of the spectrally and chemically sensitized, epitaxial ultrathin emulsion at 40° C. and held for 20 min after each antenna dye addition. The emulsion samples were then coated as in Example 1, except the silver laydown was 0.538 g/m$^2$. The dried coatings were then exposed and subjected to black and white development as in Example 1. The sensitometric results are given in Table IV.

TABLE IV

Sensitometric evaluation of antenna dyes in Example 3.

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 3-1, C | None | — | None | — | 0.04 | 191 | 269 | 1.41 | 100 |
| 3-2, I | I-20 | 1.5 | None | — | 0.06 | 162 | 246 | 1.51 | 107 |
| 3-3, I | I-20 | 1.5 | II-1 | 1.5 | 0.09 | 174 | 288 | 1.66 | 118 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 9 filter) to simulate a daylight exposure.
[e]DL/IS is the ratio of the daylight sensitivity to the intrinsic sensitivity.
[f]Norm. DL/IS is the DL/IS ratio normalized relative to the comparison dye.

The data in table IV give another example of highly fluorescent antenna dyes producing an increase in relative spectral sensitivity of an optimally sensitized emulsion.

Photographic Evaluation—Example 4

Aliquots of the conventionally spectrally and chemically sensitized emulsion of Example 2 were again treated with antenna dyes. The resulting emulsion samples were then coated on cellulose acetate film support with an antihalation backing. The coatings contained 0.538 g/m$^2$ Ag, 2.15 g/m$^2$ gelatin, and 0.969 g/m$^2$ of the cyan dye-forming coupler C-1, 4-hydroxy-6-methyl-1,3,3a,7-tetraazaindene stabilizer (2 g/mol Ag), and surfactants. A protective gelatin overcoat containing hardener was applied over the emulsion layer.

C-1

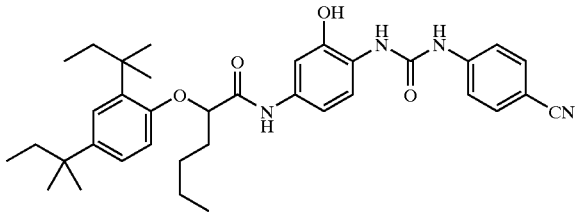

The dried coatings were given a 365 nm Hg-line exposure or a 5500K daylight exposure for 0.01 sec through a calibrated step tablet ranging in optical density from 0 to 4. The daylight exposure was additionally filtered with a Wratten No. 23a filter to remove blue and green light (wavelengths>560 nm transmitted). The exposed coatings were developed for 3 min 15 sec in the color negative Kodak Flexicolor™ C-41 process. The sensitometric results are reported in Table V.

TABLE V

Sensitometric evaluation of antenna dyes in Example 4.

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 4-1, C | None | — | None | — | 0.04 | 501 | 1905 | 3.80 | 100 |
| 4-2, I | I-20 | 1.5 | None | — | 0.06 | 447 | 2512 | 5.62 | 148 |
| 4-3, I | I-20 | 1.5 | II-1 | 1.5 | 0.09 | 479 | 2951 | 6.16 | 162 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 23A filter) to simulate a daylight exposure.
[e]DL/IS is the ratio of the daylight sensitivity to the intrinsic sensitivity.
[f]Norm. DL/IS is the DL/IS ratio normalized relative to the comparison dye.

The results in Table V show large increases in spectral sensitivity in a color photographic imaging system by addition of highly fluorescent antenna dyes to an emulsion that already possessed an optimal chemical and spectral sensitization.

Photographic Evaluation—Example 5

An emulsion was made as described in Example 1 and was also given a conventional spectral and chemical sensitization as described in Example 1, except that the conventional sensitizing dyes used were SD-3 (0.101 mmol/mol Ag) and SD-1 (0.909 mmol/mol Ag). This ratio of sensitizing dyes SD-3 to SD-1 (1/9) affords an emulsion with a maximum absorption wavelength of 650 nm. Aliquots of this conventionally sensitized emulsion were then treated with antenna dyes in the same manner described in Example 4. These emulsion samples were then coated, exposed, and processed in the same manner as in Example 4. The sensitometric results are given in Table VI below.

SD-3

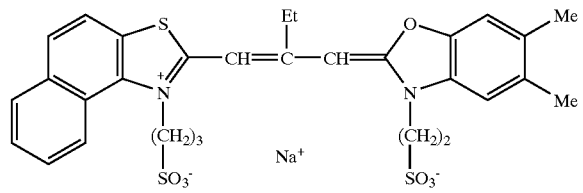

TABLE VI

Sensitometric evaluation of antenna dyes in Example 5.

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 5-1, C | None | — | None | — | 0.06 | 501 | 1660 | 3.31 | 100 |
| 5-2, I | I-20 | 1.5 | None | — | 0.08 | 437 | 1995 | 4.57 | 138 |
| 5-3, I | I-20 | 1.5 | II-1 | 1.5 | 0.11 | 468 | 2570 | 5.49 | 166 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 9 filter) to simulate a daylight exposure.
[e]DL/IS is the ratio of the daylight sensitivity to the intrinsic sensitivity.
[f]Norm. DL/IS is the DL/IS ratio normalized relative to the comparison dye.

Photographic Evaluation—Example 6

An emulsion was made as described in Example 1 and was also given a conventional spectral and chemical sensitization as described in Example 5 except that SD-3 was used at 0.631 mmol/mol Ag and SD-1 was used at 0.316 mmol/mol Ag. The ratio of sensitizing dyes SD-3 to SD-1 was 2/1. This ratio affords an emulsion with a maximum absorption wavelength of 629 nm. Aliquots of this conventionally sensitized emulsion were then treated with antenna dyes, coated, exposed, and processed in the same manner described in Example 5. The sensitometric results are given in Table VII below.

TABLE VII

Sensitometric evaluation of antenna dyes in Example 6.1

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 6-1, C | None | — | None | — | 0.09 | 537 | 1995 | 3.72 | 100 |
| 6-2, I | I-20 | 1.5 | None | — | 0.10 | 457 | 2138 | 4.68 | 126 |
| 6-3, I | I-20 | 1.5 | II-1 | 1.5 | 0.12 | 490 | 2512 | 5.13 | 138 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 23A filter) to simulate a daylight exposure.
[e]DL/IS is the ratio of the daylight sensitivity to the intrinsic sensitivity.
[f]Relative DL/IS is the DL/IS ratio normalized relative to the comparison dye.

Photographic Evaluation—Example 7

An emulsion was made as described in Example 1 and was given a conventional spectral and chemical sensitization as described in Example 5 except that the level of SD-3 was 0.708 mmol/mol Ag and the level of SD-1 was 0.177 mmol/mol Ag. This molar ratio of sensitizing dyes SD-3 to SD-1 (4/1) afforded an emulsion with a maximum absorption wavelength of 620 nm. Aliquots of this conventionally sensitized emulsion were then treated with antenna dyes, coated, exposed, and processed in the same manner described in Example 5. The sensitometric results are given in Table VIII below.

TABLE VIII

Sensitometric evaluation of antenna dyes in Example 7.

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 7-1, C | None | — | None | — | 0.09 | 501 | 1778 | 3.55 | 100 |
| 7-2, I | I-20 | 1.5 | None | — | 0.09 | 407 | 1778 | 4.37 | 123 |
| 7-3, I | I-20 | 1.5 | II-1 | 1.5 | 0.12 | 427 | 2089 | 4.89 | 138 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 23A filter) to simulate a daylight exposure.
[e]DL/IS is the ratio of the daylight sensitivity to the intrinsic sensitivity.
[f]Norm. DL/IS is the DL/IS ratio normalized relative to the comparison dye.

Photographic experiments 5, 6, and 7 indicate that the conventional sensitization of the emulsion can be changed to shorter wavelength and that the antenna dyes can still give enhance photographic sensitivity. In this case the antenna dyes have a maximum absorbance at about 623 nm. Example 7 shows that increased spectral sensitivity can be obtained even when the maximum absorption wavelength (620 nm) of the inner dye layer is somewhat less than that of the outer antenna dye layer (623 nm). The absorption spectrum of the inner dye (sensitizing dye) layer in this case is broad enough such that there is still substantial overlap between the light absorption envelope of the antenna dye and the light absorption envelope of the sensitizing dye and the fluorescence of the outer antenna dye layer has overlap with the inner dye absorption.

-continued

SD-5

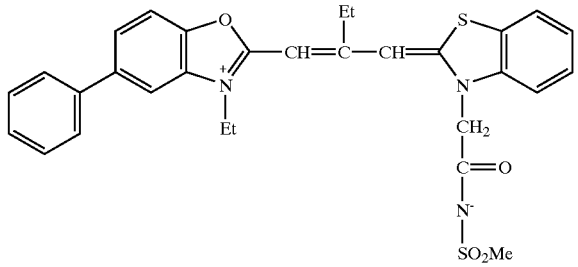

TABLE IX

Sensitometric evaluation of antenna dyes in Example 8.

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 8-1, C | None | — | None | — | 0.07 | 447 | 1778 | 3.98 | 100 |
| 8-2, I | I-20 | 1.5 | None | — | 0.06 | 479 | 646 | 1.35 | 34 |
| 8-3, I | I-20 | 1.5 | II-1 | 1.5 | 0.09 | 447 | 537 | 1.20 | 30 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 23A filter) to simulate a daylight exposure.
[e]DL/IS is the ratio of the daylight sensitivity to the intrinsic sensitivity.
[f]Norm. DL/IS is the DL/IS ratio normalized relative to the comparison dye.

Photographic Evaluation—Example 8

An emulsion was made as described in Example 1 and was also given a conventional spectral and chemical sensitization as described in Example 1, except that the green sensitizing dyes SD-4 (0.786 mmol/mol Ag) and SD-5 (0.175 mmol/mol Ag) were used in place of the red dyes SD-1 and SD-2. Aliquots of this green-sensitized emulsion were then treated with red-absorbing antenna dyes in the same manner described in Example 4. These emulsion samples were then coated, exposed, and processed in the same manner as in Example 4, except that the Wratten 9™ filter was used for the daylight exposure. The sensitometric results are given in Table IX below.

SD-4

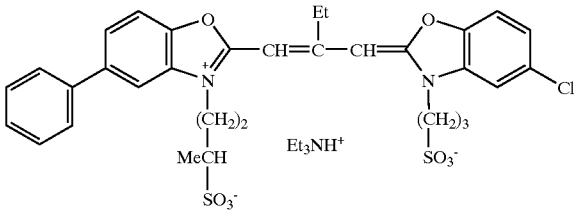

This example shows that large losses in spectral to intrinsic sensitivity ratio can occur when the dyes of the invention are used in a manner not in accord with the invention. In particular, in the present examples, the green inner dye layer has a much shorter wavelength absorption peak maximum than the red outer antenna dye layer such that there is no overlap of the outer dye layer fluorescence wavelengths with the absorption envelope of the inner dye layer. This is in sharp contrast to Examples 4 through 7, using the same outer dyes on the same emulsion substrate, but inner dyes having longer wavelength absorption such that there is overlap with the fluorescence envelope of the outer antenna dyes.

Photographic Evaluation—9

A 2.3×0.12 μm silver bromoiodide emulsion having an overall iodide content of 3.8% was prepared according to the following procedure. To a 4.6 L aqueous solution containing 0.4 weight % bone gelatin and 7 g/L sodium bromide at 58° C. was added 0.21 M silver nitrate solution with vigorous stirring at constant flow rate over a 15 min period, consuming 1.1% of the final silver for the emulsion. Subsequently, 24.8 g of ammonium sulfate was added to the vessel, followed by the addition of 152 mL sodium hydroxide at 2.5 M. After 5 min, 152 mL nitric acid at 2.5 M was added. Then 3 L of aqueous solution containing 7.4% gelatin by weight was added to the reaction vessel at 58° C. and held 5 min. Then double jet addition of an aqueous 3.0 M silver nitrate solution and an aqueous solution that was 2.97 M sodium bromide and 0.03 M potassium iodide were added simultaneously to the reaction vessel utilizing a flow rate that was accelerated 7.3× from start to finish over a period of 46 min while controlling the pBr at 1.6, consuming 70 mole % of the final silver. At 40 min into this period, 70 mL of aqueous solution of potassium hexacyanoruthenate at 0.35% by weight was added to the reaction vessel. Both silver nitrate and salt flows were halted after the period of accelerated flow, and the pBr was adjusted to 1.0 by addition of sodium bromide salt. Then 5 mL of an aqueous solution of potassium selenocyanate at 0.018% by weight was added to the reaction vessel. Silver iodide Lippmann seed comprising 3.1% of the final amount of silver was then added to the reaction vessel. After holding for a period of 2 min, the 3.0 M silver nitrate solution was used to adjust the pBr from 1.0 to 2.3. Then a 3.0 M sodium bromide solution was added simultaneously with the silver nitrate solution to the reaction vessel to control the pBr at 2.3 until a total of 12.1 mole silverbromoiodide emulsion was prepared. The emulsion was cooled to 40° C. and washed by the ultrafiltration method.

The washed emulsion was first given an optimal conventional chemical and spectral sensitization according to the following procedure. To the washed emulsion at 40° C. were added NaSCN (100 mg/mol Ag) and 3-(2-methylsulfamoylethyl)-benzothiazolium tetrafluoroborate (25 mg/mol Ag). Spectral sensitizing dyes SD-1 (B-10558, 0.7456 mmol/mol Ag) and SD-2 (B-16450, 0.1864 mmol/mol Ag), and chemical sensitizers trisodium dithiosulfato gold(I) (2.54 mg/mol Ag) and sodium thiosulfate (1.25 mg/mol Ag). The temperature of the emulsion was then raised to 60° C. and held for 20 min. Then the emulsion was cooled to 40° C. and 1-(3-acetamidophenyl)-5-mercaptotatrazole (114 mg/mol Ag) was added.

The dyes according to the invention were added to aliquots of the already fully spectrally and chemically sensitized conventional emulsion and held for 20 min at 40° C. after each dye addition. The dyes and amounts added are listed in the Table below. These emulsion samples were then coated on cellulose acetate film support with an antihalation backing. The coatings contained 0.538 g/m$^2$ Ag, 2.15 g/m$^2$ gelatin, and 0.969 g/m$^2$ of the cyan dye-forming coupler C-1, 4-hydroxy-6-methyl-1,3,3a,7-tetraazaindene stabilizer(2 g/mol Ag), and surfactants. A protective gelatin overcoat containing hardener was applied over the emulsion layer.

The dried coatings were given a 365 nm Hg-line exposure or a 5500K daylight exposure for 0.01 sec through a calibrated step tablet ranging in optical density from 0 to 4. The daylight exposure was additionally filtered with a Wratten No. 23a filter to remove blue and green light (wavelengths>560 nm transmitted). The exposed coatings were developed for 3 min 15 sec in the color negative Kodak Flexicolor™ C-41 process. The sensitometric results are reported in Table X.

TABLE X

Sensitometric evaluation of antenna dyes in Example 9.

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 9-1, C | None | — | None | — | 0.05 | 513 | 1698 | 3.31 | 100 |
| 9-2, I | I-20 | 1.5 | None | — | 0.11 | 603 | 2399 | 3.98 | 120 |
| 9-3, I | I-20 | 1.5 | II-1 | 2.0 | 0.12 | 589 | 2884 | 4.90 | 148 |
| 9-4, I | I-21 | 1.5 | None | — | 0.09 | 525 | 2512 | 4.78 | 144 |
| 9-5, 1 | 1-21 | 1.5 | II-I | 2.0 | 0.20 | 676 | 2754 | 4.07 | 123 |
| 9-6, I | 1-22 | 1.5 | None | — | 0.07 | 525 | 2138 | 4.07 | 123 |
| 9-7, I | I-22 | 1.5 | II-1 | 2.0 | 0.12 | 661 | 2818 | 4.26 | 129 |
| 9-8, C | CD-4 | 1.5 | None | — | 0.05 | 407 | 1380 | 3.39 | 102 |
| 9-9, C | CD-5 | 1.5 | None | — | 0.04 | 447 | 1514 | 3.39 | 102 |
| 9-10, C | CD-6 | 1.5 | None | — | 0.08 | 380 | 1259 | 3.31 | 100 |
| 9-11, C | CD-7 | 1.5 | None | — | 0.04 | 501 | 1585 | 3.16 | 95 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 23A filter) to simulate a daylight exposure.
[e]DL/IS is the ratio of the daylight sensitivity to the intrinsic sensitivity.
[f]Norm. DL/IS is the DL/IS ratio normalized relative to the comparison dye.

The data in Table X show large increases in relative spectral sensitivity when dyes according to the invention are added to the conventionally sensitized emulsion, while comparison dyes that do not fulfill the requirements of the invention produce little or no increase in relative spectral sensitivity.

Photographic Evaluation—10

Aliquots of the same conventionally sensitized emulsion as in Example 9 were treated with additional examples of antenna dyes. These emulsion samples were coated, exposed , and processed as in Example 9, except that the daylight exposures were filtered through a Wratten No. 9 filter to remove blue light (wavelengths>480 nm transmitted). The sensitometric results are given in Table XI.

TABLE XI

Sensitometric evaluation of antenna dyes in Example 10.

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 10-1, C | None | — | None | — | 0.06 | 513 | 2042 | 3.98 | 100 |
| 10-2, I | I-2 | 1.5 | None | — | 0.08 | 501 | 2344 | 4.68 | 118 |
| 10-3, I | I-2 | 1.5 | II-4 | 2.0 | 0.08 | 380 | 2754 | 7.25 | 182 |

TABLE XI-continued

Sensitometric evaluation of antenna dyes in Example 10.

| Example[a] | Antenna Dye 1 | Level[b] | Antenna Dye 2 | Level[b] | $D_{min}$ | IS[c] | DL[d] | DL/IS Ratio[e] | Norm. DL/IS[f] |
|---|---|---|---|---|---|---|---|---|---|
| 10-4, I | I-15 | 1.5 | None | — | 0.06 | 490 | 2512 | 5.13 | 129 |
| 10-5, I | I-15 | 1.5 | II-5 | 2.0 | 0.07 | 501 | 3631 | 7.25 | 182 |
| 10-6, I | I-20 | 1.5 | None | — | 0.13 | 562 | 3020 | 5.37 | 135 |
| 10-7, I | I-20 | 1.5 | II-5 | 2.0 | 0.15 | 617 | 3890 | 6.31 | 159 |

[a]I is an example of the invention, C is a comparison example.
[b]mmol/Ag mol.
[c]IS is the intrinsic sensitivity (reported in lux-seconds) from a 365 nm line exposure.
[d]DL is the daylight sensitivity (reported in lux-seconds) and obtained from a tungsten exposure with filtration (Wratten No. 9 filter) to simulate a daylight exposure.
[e]DL/IS is the ratio of the daylight sensitivity to the intrinsic sensitivity.
[f]Norm. DL/IS is the DL/IS ratio normalized relative to the comparison dye.

The invention has been described in detail with particular reference to certain preferred embodiments thereof, but it will be understood that variations and modifications can be effected within the spirit and scope of the invention.

What is claimed is:

1. A silver halide photographic material comprising at least one silver halide emulsion comprising silver halide grains having associated therewith at least two dyes:

(a) a first dye that has at least one anionic substituent and that is capable of spectrally sensitizing a silver halide emulsion; and (b) a second dye that absorbs light at an equal or shorter wavelength than the first dye and that has at least one cationic substituent and that is highly fluorescent.

2. A silver halide photographic material according to claim 1, wherein the first dye is present at a concentration of at least 80% of monolayer coverage and the second dye is present in an amount of at least 50% of monolayer coverage.

3. A silver halide photographic material according to claim 1, further comprising an additional dye that has at least one anionic substituent and that is capable of spectrally sensitizing a silver halide emulsion.

4. A silver halide photographic material according to claim 1, wherein the first dye is a cyanine dye.

5. A silver halide photographic material according to claim 4, wherein the cyanine dye is of Formula Ia:

Ia

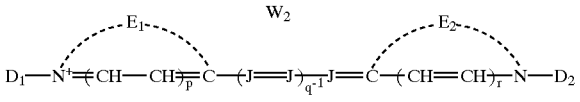

wherein:

$E_1$ and $E_2$ may be the same or different and represent the atoms necessary to form a substituted or unsubstituted heterocyclic ring which is a basic nucleus;

each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl and at least one of $D_1$ and $D_2$ contains an anionic substituent, $W_2$ is one or more counterions as necessary to balance the charge.

6. A silver halide photographic material according to claim 1, wherein the first dye is a merocyanine dye.

7. A silver halide photographic material according to claim 6, wherein the merocyanine dye is of Formula Ib:

Ib

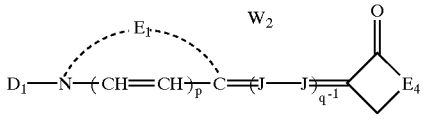

wherein $E_1$ represents the atoms necessary to form a substituted or unsubstituted heterocyclic ring which is a basic nucleus; $D_1$ represents substituted or unsubstituted alkyl or unsubstituted aryl and contains an anionic substituent;

J represents a substituted or unsubstituted methine group;

p represents 0 or 1, q is a positive integer of from 1 to 4, $E_4$ represents the atoms necessary to complete a substituted or unsubstituted heterocyclic acidic nucleus;

and $W_2$ is one or more counterions as necessary to balance the charge.

8. A silver halide photographic material according to claim 1, further comprising an additional dye that absorbs light at an equal or shorter wavelength than the first dye and that has at least one cationic substituent and that is highly fluorescent.

9. A silver halide photographic material according to claim 1 wherein the second dye forms a lyotropic liquid-crystalline phase in aqueous gelatin.

10. A silver halide photographic material according to claim 1 wherein the second dye forms a lyotropic liquid-crystalline phase in aqueous gelatin at a concentration of 1 weight percent or less.

11. A silver halide photographic material according to claim 1 wherein the second dye forms a highly fluorescent J-aggregate in aqueous gelatin.

12. A silver halide photographic material according to claim 1 wherein the second dye forms a J-aggregate in aqueous gelatin that has a florescence quantum yield of 0.02 or greater.

13. A silver halide photographic material according to claim 1 wherein the second dye forms a J-aggregate in aqueous gelatin that has a florescence quantum yield of 0.05 or greater.

14. A silver halide photographic material according to claim 1 wherein the first dye is capable of spectrally sensitizing a silver halide emulsion at a wavelength beyond 600 nm and the second dye has a maximum light absorption beyond 600 nm.

15. A photographic material according to claim 1, wherein the second dye is a merocyanine dye, oxonol, dye, arylidene dye, complex merocyanine dye, styryl dye, hemioxonol dye, anthraquinone dye, triphenylmethane dye, azo dye type, azomethine dye, or coumarin dye.

16. A silver halide photographic material according to claim 15 wherein the second dye is a merocyanine dye.

17. A silver halide photographic material according to claim 1 further comprising a third dye that is a merocyanine dye and that has at least one anionic substituent and that forms a highly fluorescent J-aggregate in aqueous gelatin.

18. A silver halide photographic material according to claim 1, wherein the second dye is of Formula IV:

IV

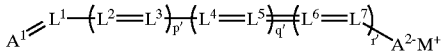

wherein $A^1$ and $A^2$ are ketomethylene or activated methylene moieties, $L^1$–$L^7$ are substituted or unsubstituted methine groups, $M^+$ is a cation, and p', q' and r' are independently 0 or 1.

19. A silver halide photographic material according to claim 1, wherein the second dye is of Formulae IV-A or IV-B:

IV-A

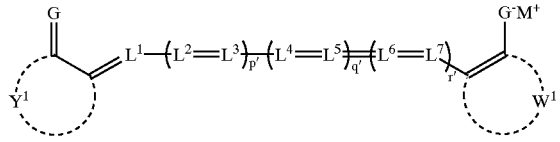

IV-B

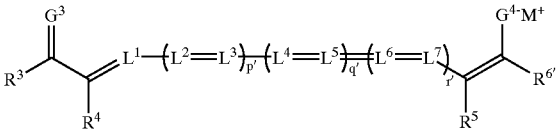

wherein $W^1$ and $Y^1$ are the atoms required to form a cyclic activated methylene/ketomethylene moiety; $R^3$ and $R^5$ are aromatic or heteroaromatic groups; $R^4$ and $R^{6'}$ are electron-withdrawing groups; $G^1$ to $G^4$ is O or dicyanovinyl (—$C(CN)_2$)) and p', q', and r' are independently 0 or 1, and $L^1$ to $L^7$ are substituted or unsubstituted methine groups.

20. A silver halide photographic material according to claim 1, wherein the second dye is of Formula V

V

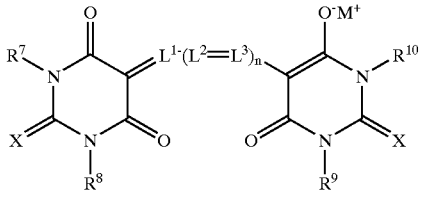

wherein X is oxygen or sulfur; $R^7$–$R^{10}$ each independently represent an unsubstituted or substituted alkyl group, an unsubstituted or substituted aryl group or an unsubstituted or substituted heteroaryl group; $L^1$, $L^2$ and $L^3$ each independently represent substituted or unsubstituted methine groups; M+ represents a proton or an inorganic or organic cation; and n is 0, 1, 2 or 3.

21. A silver halide photographic material according to claim 1, wherein the second dye is of Formula VI:

VI

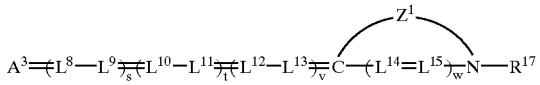

wherein $A^3$ is a ketomethylene or activated methylene moiety; each $L^8$ to $L^{15}$ are substituted or unsubstituted methine groups, $Z^1$ represents the non-metallic atoms necessary to complete a substituted or unsubstituted ring system containing at least one 5 or 6-membered heterocyclic nucleus; $R^{17}$ represents a substituted or unsubstituted alkyl, aryl, or aralkyl group, and each of s, t, v or w is 0 or 1.

22. A silver halide photographic material according to claim 1, wherein the second dye is of Formula VII-A:

VII-A

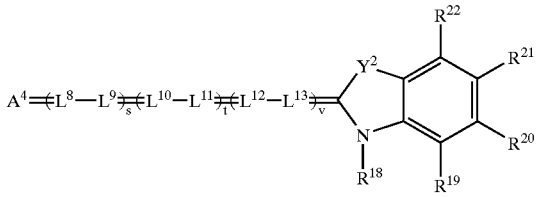

wherein $A^4$ is an activated methylene moeity or a ketomethylene moeity, $R^{18}$ is substituted or unsubstituted aryl, alkyl or aralkyl, $R^{19}$ to $R^{22}$ each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; $L^8$ through $L^{13}$ are substituted or unsubstituted methine groups, $Y^2$ is O, S, Te, Se, $NR_x$, or $CR_yR_z$ (where Rx, Ry and Rz are alkyl groups with 1–5 carbons), and s and t and v are independently 0 or 1.

23. A silver halide photographic material according to claim 1, wherein the second dye is of Formula VIII-A:

VIII-A

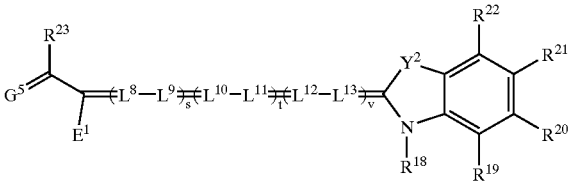

wherein $R^{23}$ is a substituted or unsubstituted aryl, heteroaryl, or a substituted or unsubstituted amino group; $G^5$ is O or dicyanovinyl ($C(CN)_2$), $E^1$ is an electron-withdrawing group, $R^{18}$ is substituted or unsubstituted aryl, alkyl or aralkyl, $R^{19}$ to $R^{22}$ each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; $L^8$ through $L^{13}$ are substituted or unsubstituted methine groups, $Y^2$ is O, S, Te, Se, $NR_x$, or $CR_yR_z$ (where Rx, Ry and Rz are alkyl groups with 1–5 carbons), and s and t and v are independently 0 or 1.

24. A silver halide photographic material according to claim 1, wherein the second dye is of Formula VIII-B:

VIII-B

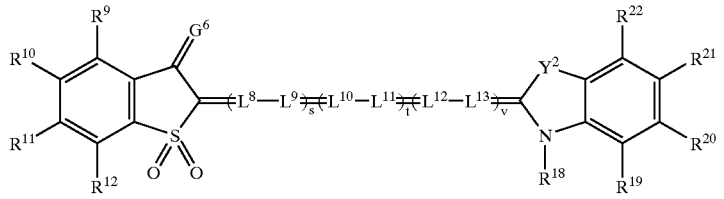

wherein $G^6$ is oxygen (O) or dicyanovinyl ($C(CN)_2$), $R^{18}$ is substituted or unsubstituted aryl, alkyl or aralkyl, $R^9$ to $R^{12}$ and $R^{19}$ to $R^{22}$ each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; $L^8$ through $L^{13}$ are substituted or unsubstituted methine groups, $Y^2$ is O, S, Te, Se, $NR_x$, or $CR_yR_z$ (where Rx, Ry and Rz are alkyl groups with 1–5 carbons), and s and t and v are independently 0 or 1.

25. A silver halide photographic material according to claim 1, wherein the second dye is of Formula VIII-C:

VIII-C

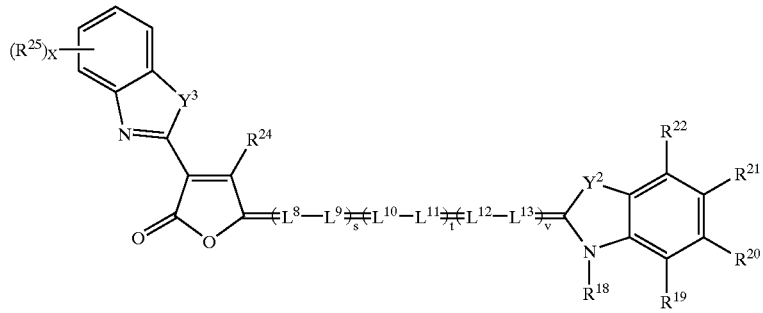

wherein $R^{25}$ groups each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents, $Y^3$ represents O, S, $NR_x$, or $CR_yR_z$ (where Rx, Ry and Rz are alkyl groups with 1–5 carbons), x is 0, 1, 2, 3 or 4, $R^{24}$ represents aryl, alkyl or acyl, and $Y^2$ is O, S, Te, Se, $NR_x$, or $CR_yR_z$ (where Rx, Ry and Rz are alkyl groups with 1–5 carbons), $R^{18}$ is substituted or unsubstituted aryl, alkyl or aralkyl, $R^{19}$ through $R^{22}$ each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents, $L^8$ through $L^{13}$, and, s, t and v are independently 0 or 1.

26. A silver halide photographic material according to claim 1, wherein the second dye is of Formula VIII-D:

VIII-D

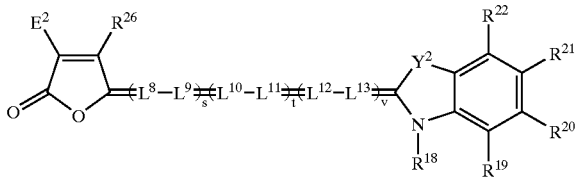

wherein $E^2$ represents an electron-withdrawing group, preferably cyano, $R^{26}$ represents aryl, alkyl or acyl, and $R^{18}$ is substituted or unsubstituted aryl, alkyl or aralkyl, $R^{19}$ to $R^{22}$ each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; $L^8$ through $L^{13}$ are substituted or unsubstituted methine groups, $Y^2$ is O, S, Te, Se, $NR_x$, or $CR_yR_z$ (where Rx, Ry and Rz are alkyl groups with 1–5 carbons), and s and t and v are independently 0 or 1.

27. A silver halide photographic material according to claim 1, wherein the second dye is of Formula VIII-E:

VIII-E

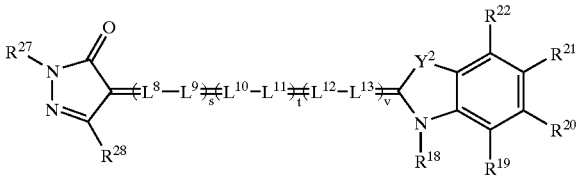

wherein $R^{27}$ is a hydrogen, substituted or unsubstituted alkyl, aryl or aralkyl, $R^{28}$ is substituted or unsubstituted alkyl, aryl or aralkyl, alkoxy, amino, acyl, alkoxycarbonyl, carboxy, carboxylate, cyano, or nitro; $R^{18}$ is substituted or unsubstituted aryl, alkyl or aralkyl, $R^{19}$ to $R^{22}$ each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; $L^8$ through $L^{13}$ are substituted or unsubstituted methine groups, $Y^2$ is O, S, Te, Se, $NR_x$, or $CR_yR_z$ (where Rx, Ry and Rz are alkyl groups with 1–5 carbons), and s and t and v are independently 0 or 1.

28. A silver halide photographic material according to claim 1, wherein the second dye is of Formula VIII-F:

VIII-F

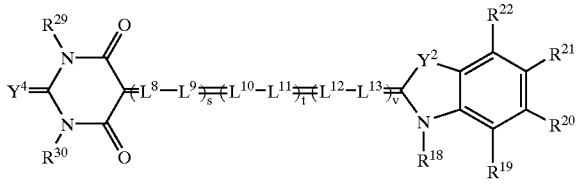

wherein $R^{29}$ and $R^{30}$ are each independently a hydrogen, substituted or unsubstituted alkyl, aryl or aralkyl, $Y^4$ is O or S, $R^{18}$ is substituted or unsubstituted aryl, alkyl or aralkyl, $R^{19}$ to $R^{22}$ each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; $L^8$ through $L^{13}$ are substituted or unsubstituted methine groups, and s and t and v are independently 0 or 1.

29. A silver halide photographic material according to claim 1, wherein the second dye is of Formula IX:

IX

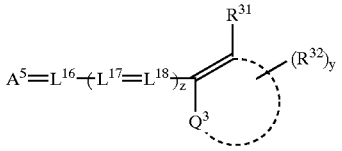

wherein $A^5$ is a ketomethylene or activated methylene, $L^{16}$ through $L^{18}$ are substituted or unsubstituted methine, $R^{31}$ is alkyl, aryl or aralkyl, $Q^3$ represents the non-metallic atoms necessary to complete a substituted or unsubstituted ring system containing at least one 5- or 6-membered heterocyclic nucleus, $R^{32}$ represents hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; y is 0, 1, 2, 3 or 4, z is 0, 1 or 2.

30. A silver halide photographic material according to claim 1, wherein the second dye is of Formula X:

Formula X

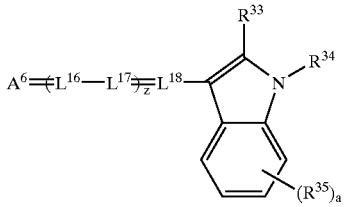

wherein $A^6$ is a ketomethylene or activated methylene, $L^{16}$ through $L^{18}$ are substituted or unsubstituted methine groups, $R^{33}$ is substituted or unsubstituted alkyl, aryl or aralkyl, $R^{34}$ is substituted or unsubstituted aryl, alkyl or aralkyl, $R^{35}$ groups each independently represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; z is 0, 1 or 2, and a is 0, 1, 2, 3 or 4.

31. A silver halide photographic material according to claim 1, wherein the second dye is of Formula XI:

Formula XI

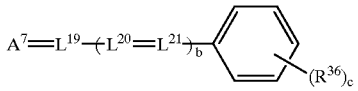

wherein $A^7$ represents a ketomethylene or activated methylene moiety, $L^{19}$ through $L^{21}$ represent substituted or unsubstituted methine groups, $R^{36}$ groups each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; b represents 0 or 1, and c represents 0, 1, 2, 3 or 4.

32. A silver halide photographic material according to claim 1, wherein the second dye is of Formula XII:

Formula XII

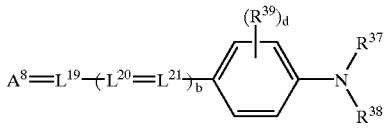

wherein $A^8$ is a ketomethylene or activated methylene, $L^{19}$ through $L^{21}$ are substituted or unsubstituted methine groups and b represents 0 or 1, $R^{39}$ groups each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; and $R^{37}$ and $R^{38}$ each individually represent substituted or unsubstituted aryl, alkyl or aralkyl, and d represents 0, 1, 2, 3 or 4.

33. A silver halide photographic material according to claim 1, wherein the second dye is of Formula XIII:

Formula XIII

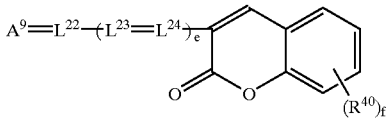

wherein $A^9$ is a ketomethylene or activated methylene moiety, $L^{22}$ through $L^{24}$ are substituted or unsubstituted methine groups, e is 0 or 1, $R^{40}$ groups each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; and f is 0, 1, 2, 3 or 4.

34. A silver halide photographic material according to claim 1, wherein the second dye is of Formula XIV:

Formula XIV

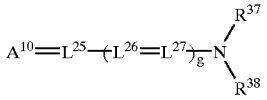

wherein $A^{10}$ is a ketomethylene or activated methylene moiety, $L^{25}$ through $L^{27}$ are substituted or unsubstituted methine groups, g is 0, 1 or 2, and $R^{37}$ and $R^{38}$ each individually represent substituted or unsubstituted aryl, alkyl or aralkyl.

35. A silver halide photographic material according to claim 1, wherein the sedond dye is of Formula XV:

Formula XV

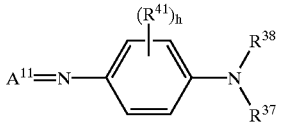

wherein $A^{11}$ is a ketomethylene or activated methylene moiety, $R^{41}$ groups each individually represent hydrogen, alkyl, cycloalkyl, alkeneyl, substituted or unsubstituted aryl, heteroaryl or aralkyl, alkylthio, hydroxy, hydroxylate, alkoxy, amino, alkylamino, halogen, cyano, nitro, carboxy, acyl, alkoxycarbonyl, aminocarbonyl, sulfonamido, sulfamoyl, including the atoms required to form fused aromatic or heteroaromatic rings, or groups containing solubilizing substituents as described above for Y; $R^{37}$ and $R^{38}$ each represent substituted or unsubstituted aryl, alkyl or aralkyl, and h is 0, 1, 2, 3, or 4.

36. A silver halide photographic material according to claim 1, wherein he second dye is of Formula XVI:

$$Q^4—N=N—Q^5$$ Formula XVI wherein $Q^4$ and $Q^5$ each represents the atoms necessary to form at least one heterocyclic or carbocyclic, fused or unfused 5 or 6-membered-ring conjugated with the azo linkage.

37. A silver halide photographic material according to claim 1 wherein the second dye is of Formula XVII:

XVII

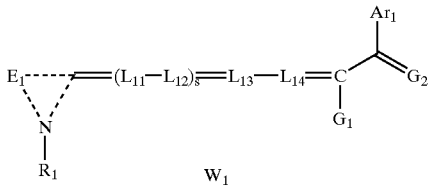

wherein:

$R_1$ represents is a substituted or unsubstituted alkyl or aryl group;

$E_1$ represents the atoms necessary to complete a substituted or unsubstituted 5- or 6-membered heterocyclic nucleus;

$Ar_1$ is a substituted or unsubstituted aryl or a substituted or unsubstituted heteroaryl group;

$L_{11}$ through $L_{14}$ are substituted or unsubstituted methine groups;

s is 0 or 1;

$G_1$ is an electron-withdrawing group;

$G_2$ is O or dicyanovinyl ($C(CN)_2$);

$W_1$ is a counterion if necessary.

38. A silver halide photographic material according to claim 37, wherein:

$E_1$ represents the atoms necessary to complete a substituted or unsubstituted thiazole nucleus, selenazole nucleus, quinoline nucleus, tellurazole nucleus, benzimidazole nucleus, pyridine nucleus,-thiadiazole, or indole nucleus;

$G_1$ is cyano;

$G_2$ is ($C(CN)_2$);

$R_1$ represents a substituted alkyl or aryl group that has at least one cationic substituent.

39. A silver halide photographic material according to claim 38, wherein:

$E_{11}$ represents the atoms necessary to complete a substituted or unsubstituted benzothiazole nucleus or quinoline nucleus $R_{11}$ is represented by:

$$—(L)—T$$

where L is a substituted or unsubstituted linking group that is at least 4 atoms long and T is a group having a charge of +1 or greater.

40. A silver halide photographic material according to claim 1, wherein the second dye is of Formula XVIII-A

XVIII-A

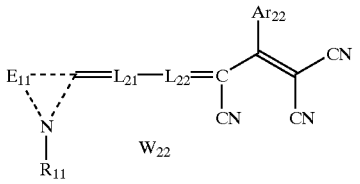

wherein:

$E_{11}$ represents the atoms necessary to complete a substituted or unsubstituted benzothiazole nucleus, a substituted or unsubstituted benzoxazole nucleus, a substituted or unsubstituted benzoselenazole nucleus, a substituted or unsubstituted pyridne nucleus, a substituted or unsubstituted quinoline nucleus, a substituted or unsubstituted benzotellurazole nucleus, a substituted or unsubstituted benzimidazole nucleus,or a substituted or unsubstituted indole nucleus;

$Ar_{22}$ is a substituted or unsubstituted aryl or a substituted or unsubstituted heteroaryl group;

$R_{11}$ is a substituted alkyl or aryl group containing a cationic substituent;

$L_{21}$ and $L_{22}$ are substituted or unsubstituted methine groups;

$W_{22}$ is one or more ions as needed to balance the charge on the molecule.

41. A silver halide photographic material according to claim 40 further comprising a third dye of Formula XVIII-B

XVIII-B

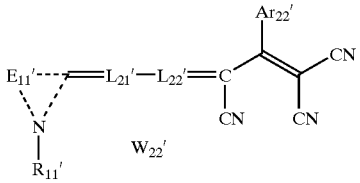

wherein:

$E_{11}'$ represents the atoms necessary to complete a substituted or unsubstituted benzothiazole nucleus, a substituted or unsubstituted benzoelenazole nucleus, a substituted or unsubstituted quinoline nucleus, a substituted or unsubstituted benzotellurazole nucleus, a substituted or unsubstituted pyridnine, or a substituted or unsubstituted indole nucleus;

$Ar_{22}'$ represents a substituted or unsubstituted aryl or a substituted or unsubstituted heteroaryl group;

$R_{11}'$ represents a substituted or unsubstituted alkyl or aryl group containing n anionic substituent;

$L_{21}'$ and $L_{22}'$ represent substituted or unsubstituted methine groups;

$W_{22}'$ represents one or more ions as needed to balance the charge on the molecule.

42. A silver halide photographic material according to claim 40 or claim 41 wherein $E_{11}'$ represents the atoms necessary to complete a substituted or unsubstituted benzothiazole nucleus or quinoline nucleus $R_{11}'$ is represented by:

—(L')—T' where L' is a substituted or unsubstituted linking group that is at least 2 atoms long and T ' is a group having a charge of −1.

43. A silver halide photographic material according to claim 1, wherein the second dye is of Formula XX

XX

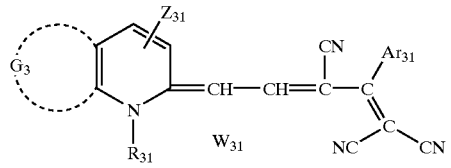

wherein:

$R_{31}$ represents a substituted alkyl group;

$Z_{31}$ represents a hydrogen, a halogen, a cyano group, a substituted or unsubstituted alkyl group, a substituted or unsubstituted aryl group, a substituted or unsubstituted heteroaryl group, an aminoalkyl group, a carbamoyl group, or a fused aromatic ring;

$G_3$ represents represent the atoms necessary to complete a substituted or unsubstituted benzene which may be fused to other rings, $Ar_{31}$ represents a substituted or unsubstituted aryl or a substituted or unsubstituted heteroaryl group and $Ar_{31}$ may have fused rings;

$W_{31}$ is one or more ions as needed to balance the charge on the molecule.

44. A silver halide photographic material according to claim 1, wherein the second dye is of Formula XIX:

XIX

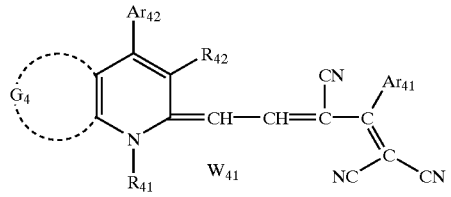

wherein:

$R_{41}$ represents a substituted or unsubstituted alkyl group;

$R_{42}$ represents a hydrogen, a substituted or unsubstitued alkyl group, a substituted or unsubstitued aromatic group, or a halogen;

$G_4$ represents the atoms necessary to complete a substituted or unsubstituted benzene which may be fused to other rings, $Ar_{41}$ and $Ar_{42}$ independently represent a substituted or unsubstituted aryl or a substituted or unsubstituted heteroaryl groups which may have fused rings;

$W_{41}$ is one or more ions as needed to balance the charge on the molecule.

45. A silver halide photographic material according to claim 1, wherein the second dye is of Formula XXI

XXI

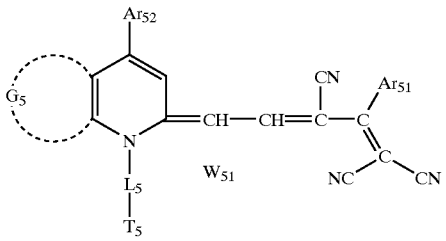

wherein:

$L_5$ represents a substituted or unsubstituted alkyl group having at least 3 carbon atoms;

$T_5$ represents a substituted or unsubstituted ammonium group, guanidinium group, or amidinium group;

$G_5$ represents the atoms necessary to complete a substituted or unsubstituted benzene which may be fused to other rings, $Ar_{51}$ and $Ar_{52}$ independently represent a substituted or unsubstituted aryl or heteroaryl groups which may have fused rings:

$W_{51}$ is one or more ions as needed to balance the charge on the molecule.

46. A silver halide photographic material according to claim 45, containing a third dye Formula XXI-A:

XXI-A

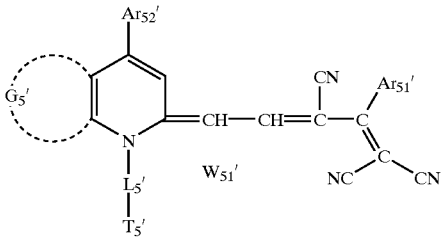

wherein:

$L_5'$ represents a substituted or unsubstituted alkyl group having at least 2 carbon atoms;

$T_5'$ represents a group having a negative charge;

$G_5'$ represents the atoms necessary to complete a substituted or unsubstituted benzene which may be fused to other rings, $Ar_{51}'$ and $Ar_{52}'$ independently represent a substituted or unsubstituted aryl or substituted or unsubstituted heteroaryl groups and $Ar_{51}'$ and $Ar_{52}'$ may have fused rings;

$W_{51}'$ is one or more ions as needed to balance the charge on the molecule.

* * * * *